US009472362B2

(12) United States Patent
Uitto et al.

(10) Patent No.: US 9,472,362 B2
(45) Date of Patent: Oct. 18, 2016

(54) SWITCH

(71) Applicant: ABB Oy, Helsinki (FI)

(72) Inventors: Oskari Uitto, Vaasa (FI); Aki Suutarinen, Vaasa (FI); Rainer Kolmonen, Laihia (FI)

(73) Assignee: ABB Oy, Helsinki (FI)

( * ) Notice: Subject to any disclaimer, the term of this patent is extended or adjusted under 35 U.S.C. 154(b) by 169 days.

(21) Appl. No.: 14/099,134

(22) Filed: Dec. 6, 2013

(65) Prior Publication Data

US 2014/0097155 A1 Apr. 10, 2014

Related U.S. Application Data

(63) Continuation of application No. PCT/FI2012/050562, filed on Jun. 5, 2012.

(30) Foreign Application Priority Data

Jun. 7, 2011 (FI) ..... 20110196

(51) Int. Cl.
*H01H 19/14* (2006.01)
*H01H 33/12* (2006.01)
(Continued)

(52) U.S. Cl.
CPC ..... *H01H 33/12* (2013.01); *H01H 1/06* (2013.01); *H01H 1/2041* (2013.01); *H01H 1/42* (2013.01);
(Continued)

(58) Field of Classification Search
CPC ..... H01H 33/12; H01H 33/08; H01H 19/28; H01H 19/02; H01H 33/42; H01H 1/06; H01H 11/00; H01H 1/42; H01H 1/2041; H01H 19/10; H01H 19/36; H01H 19/64
USPC ..... 200/564, 336
See application file for complete search history.

(56) References Cited

U.S. PATENT DOCUMENTS 3,800,106 A 3/1974 Simmons
4,861,949 A 8/1989 Bortolloni et al.
(Continued)

FOREIGN PATENT DOCUMENTS

CN 102007560 A 4/2011
CN 201804765 U 4/2011
(Continued)

OTHER PUBLICATIONS

Chinese Office Action (Notification of First Office Action) dated Mar. 25, 2014, issued by the State Intellectual Property Office of the People's Republic of China in corresponding Chinese Patent Application No. 201210185996.9. (English language translation of Office Action only) (8 pages).
(Continued)

*Primary Examiner* — Renee Luebke
*Assistant Examiner* — Lheiren Mae A Caroc
(74) *Attorney, Agent, or Firm* — Taft Stettinius & Hollister LLP

(57) ABSTRACT

A rotation mechanism for a rotary switch and a method of operating a rotary switch are provided. The rotation mechanism includes a mechanism shaft for switching the switch between open and closed positions of the switch, a crank rotationally connected to the mechanism shaft, a spring connected to the crank, where the spring has a dead point between the open and closed positions of the switch, and a force transmission roll rotationally connected to the crank. The mechanism shaft, crank and force transmission roll have a common axis of rotation. There is a predetermined rotational free-play between the rotation of the mechanism shaft and the crank, and a predetermined rotational free-play between the rotation of the crank and the force transmission roll.

19 Claims, 13 Drawing Sheets

(51) Int. Cl.

| | |
|---|---|
| ***H01H 1/20*** | (2006.01) |
| ***H01H 1/42*** | (2006.01) |
| ***H01H 19/10*** | (2006.01) |
| ***H01H 19/36*** | (2006.01) |
| ***H01H 19/64*** | (2006.01) |
| ***H01H 1/06*** | (2006.01) |
| ***H01H 19/02*** | (2006.01) |
| ***H01H 11/00*** | (2006.01) |
| ***H01H 33/42*** | (2006.01) |
| ***H01H 19/28*** | (2006.01) |
| ***H01H 33/08*** | (2006.01) |

(52) U.S. Cl.

CPC ..... *H01H 11/00* (2013.01); *H01H 19/02* (2013.01); *H01H 19/10* (2013.01); *H01H 19/28* (2013.01); *H01H 19/36* (2013.01); *H01H 19/64* (2013.01); *H01H 33/08* (2013.01); *H01H 33/42* (2013.01); *Y10T 29/49105* (2015.01)

(56) References Cited

U.S. PATENT DOCUMENTS

| | | | | |
|---|---|---|---|---|
| 5,143,403 | A | 9/1992 | Föhl | |
| 5,945,650 | A | 8/1999 | Holland et al. | |
| 5,969,307 | A | 10/1999 | Lacroix et al. | |
| 5,969,308 | A | 10/1999 | Pever | |
| 6,111,208 | A | 8/2000 | Rochon et al. | |
| 7,005,597 | B2 * | 2/2006 | Mori | H01H 37/60 200/336 |
| 7,368,676 | B2 * | 5/2008 | Mattlar | H01H 19/24 200/400 |
| 8,448,539 | B2 * | 5/2013 | Chen | H01H 5/10 200/400 |
| 8,513,550 | B2 | 8/2013 | Chen | |
| 8,575,504 | B2 | 11/2013 | Eisner | |
| 2007/0131528 | A1 | 6/2007 | Mattlar et al. | |
| 2010/0038222 | A1 | 2/2010 | Lindsey | |
| 2011/0147185 | A1 | 6/2011 | Soininen et al. | |
| 2011/0259718 | A1 | 10/2011 | Weber et al. | |
| 2014/0090969 | A1 | 4/2014 | Uitto et al. | |

FOREIGN PATENT DOCUMENTS

| | | | |
|---|---|---|---|
| DE | 504 327 | C | 8/1930 |
| DE | 694 058 | C | 7/1940 |
| DE | 714 913 | C | 12/1941 |
| DE | 34 28 519 | A1 | 2/1986 |
| EP | 0 142 443 | A2 | 5/1985 |
| EP | 0 297 055 | A1 | 12/1988 |
| EP | 0 886 292 | A1 | 12/1998 |
| EP | 2 107 581 | A1 | 10/2009 |
| FI | 11045 | | 10/1924 |
| GB | 1159729 | | 7/1969 |
| WO | WO 2005/069328 | A1 | 7/2005 |
| WO | WO 2009/153395 | A1 | 12/2009 |

OTHER PUBLICATIONS

Chinese Office Action (Notification of First Office Action) dated Mar. 21, 2014, issued by the State Intellectual Property Office of the People's Republic of China in corresponding Chinese Patent Application No. 201210185986.5. (English language translation of Office Action only) (9 pages).

International Search Report (PCT/ISA/210) mailed on Sep. 27, 2012, by the Finnish Patent Office as the International Searching Authority for International Application No. PCT/FI2012/050559.

International Search Report (PCT/ISA/210) mailed on Sep. 27, 2012, by the Finnish Patent Office as the International Searching Authority for International Application No. PCT/FI2012/050561.

International Preliminary Report on Patentability (PCT/IPEA/409 issued on May 21, 2013 by the Finnish Patent Office as the International Searching Authority for International Application No. PCT/FI2012/050561.

International Search Report (PCT/ISA/210) mailed on Oct. 1, 2012, by the Finnish Patent Office as the International Searching Authority for International Application No. PCT/FI2012/050560.

International Preliminary Report on Patentability (PCT/IPEA/409 issued on May 22, 2013 by the Finnish Patent Office as the International Searching Authority for International Application No. PCT/FI2012/050560.

International Search Report (PCT/ISA/210) mailed on Oct. 2, 2012, by the Finnish Patent Office as the International Searching Authority for International Application No. PCT/FI2012/050562.

Office Action issued by the U.S. Patent and Trademark Office in the U.S. Appl. No. 14/099,112, mailed Jul. 9, 2015, U.S. Patent and Trademark Office, Alexandria, VA. (13 pages).

Office Action issued by the U.S. Patent and Trademark Office in the U.S. Appl. No. 14/099,075, mailed Jul. 9, 2015, U.S. Patent and Trademark Office, Alexandria, VA. (13 pages).

Office Action issued by the U.S. Patent and Trademark Office in the U.S. Appl. No. 14/099,197, mailed Jun. 18, 2015, U.S. Patent and Trademark Office, Alexandria, VA. (15 pages).

* cited by examiner

SWITCH

RELATED APPLICATIONS

This application claims priority as a continuation application under 35 U.S.C. §120 to PCT/FI2012/050562, which was filed as an International Application on Jun. 5, 2012 designating the U.S., and which claims priority to European Application 20110196 filed in Europe on Jun. 7, 2011. The entire contents of these applications are hereby incorporated by reference in their entireties.

FIELD

The present disclosure relates to rotary switches, and more particularly to multipole switches used in connecting and disconnecting a solar panel from a system. In direct current use, such a multipole switch may be used to connect a plurality of contacts serially to achieve an improved switching capability.

BACKGROUND INFORMATION

It is aimed to place the contact poles of the switch as far as possible from each other to reduce the risk of an arc firing between them. GB1159729 discloses how the contacts of two vertically adjacent bodies are arranged in a 90 degrees angle to each other. In GB1159729, due to the round shape of the contact bodies, the stationary contacts point directly outwards, whereby extra space is needed between adjacent switches.

EP0886292 A1 discloses a rectangular switch body, where the contacts come out of the body from a direct side of the body. Thus, an angle is formed between a connection portion and a contact portion of the stationary contact such that the connection portion projects perpendicularly from an outer wall of the body, but the contact portion points substantially towards the rotation axis of the switch, A drawback is that the clearance in the asymmetric support of the switch 8-1 in FIG. 8A of EP0886292 A1 permits swinging of the contact portion.

WO 2005069328A1 discloses a contact module having two stationary contacts on opposite sides of the body and a rotary contact assembled on the roll turns around its center point therebetween, whereby two contact gaps are formed. A rectangular opening is formed through the roll, and a contact to be placed therein includes two blades, and a spring element holding the blades separate from each other, and includes a locking member to prevent longitudinal movement of the blades.

EP2107581 A1 discloses a contact module which includes one movable contact and stationary contacts arranged substantially at opposite corners of the contact module. The movable contacts of overlapping modules are arranged to a 90 degrees angle to each other, whereby the stationary contacts, to which the connection screws connect, are equipped to overlapping modules alternately to different sides of the body such that the connection screws are positioned as far as possible from each other to reduce an arc firing there between. It is required to cover unequipped spaces for the stationary contact and connection screw with an insulating plug. Except the base body, the contact modules can be identical, but right-hand and left-hand stationary contacts are needed, which are mirror-images from each other. The switch axis is formed of shank modules, one per each contact module. The movable contact is formed of two copper plates pressed together and insulating cardboards attached between them. A drawback is that the axis of the shank module passes the connector reducing the cross-section of the conducting area, whereby the square shank module axis has to have a small cross-section. Due to this, the torque causes a strong shear force on the axle member. The clearance between the axle member and the next shank module combined with the small diameter of the axle member causes a non-simultaneous function in a switch equipped with a plurality of contact modules. Due to the cardboard insulation, the mounting of the stationary contacts and movable contacts is difficult, because the stationary contact needs to be pushed from the side to space between two cardboard plates.

SUMMARY

An exemplary embodiment of the present disclosure provides a rotation mechanism for a rotary switch. The mechanism includes a mechanism shaft configured to switch the switch between open and closed positions of the switch, a crank rotationally connected to the mechanism shaft, and a spring connected to the crank. The spring has a dead point between the open and closed positions of the switch. The mechanism also includes a force transmission roll rotationally connected to the crank. The mechanism shaft, the crank and the force transmission roll have a common axis of rotation. There is a predetermined rotational free-play between a rotation of the mechanism shaft and the crank, and a predetermined rotational free-play between a rotation of the crank and the force transmission roll.

An exemplary embodiment of the present disclosure provides a method of operating a rotary switch. The exemplary method includes initiating rotation of a mechanism shaft from a first position to a second position of the switch, where the rotation engages a crank connected to a spring and rotationally coupled to mechanism shaft. The exemplary method also includes rotating the mechanism shaft further such that the spring approaches its dead point, wherein close to the dead point of the spring, the crank engages a force transmission roll rotationally coupled to the crank. In addition, the exemplary method includes rotating the mechanism shaft further such that the spring passes the dead point, wherein after the dead point the crank and the force transmission roll rotate more than the mechanism shaft.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
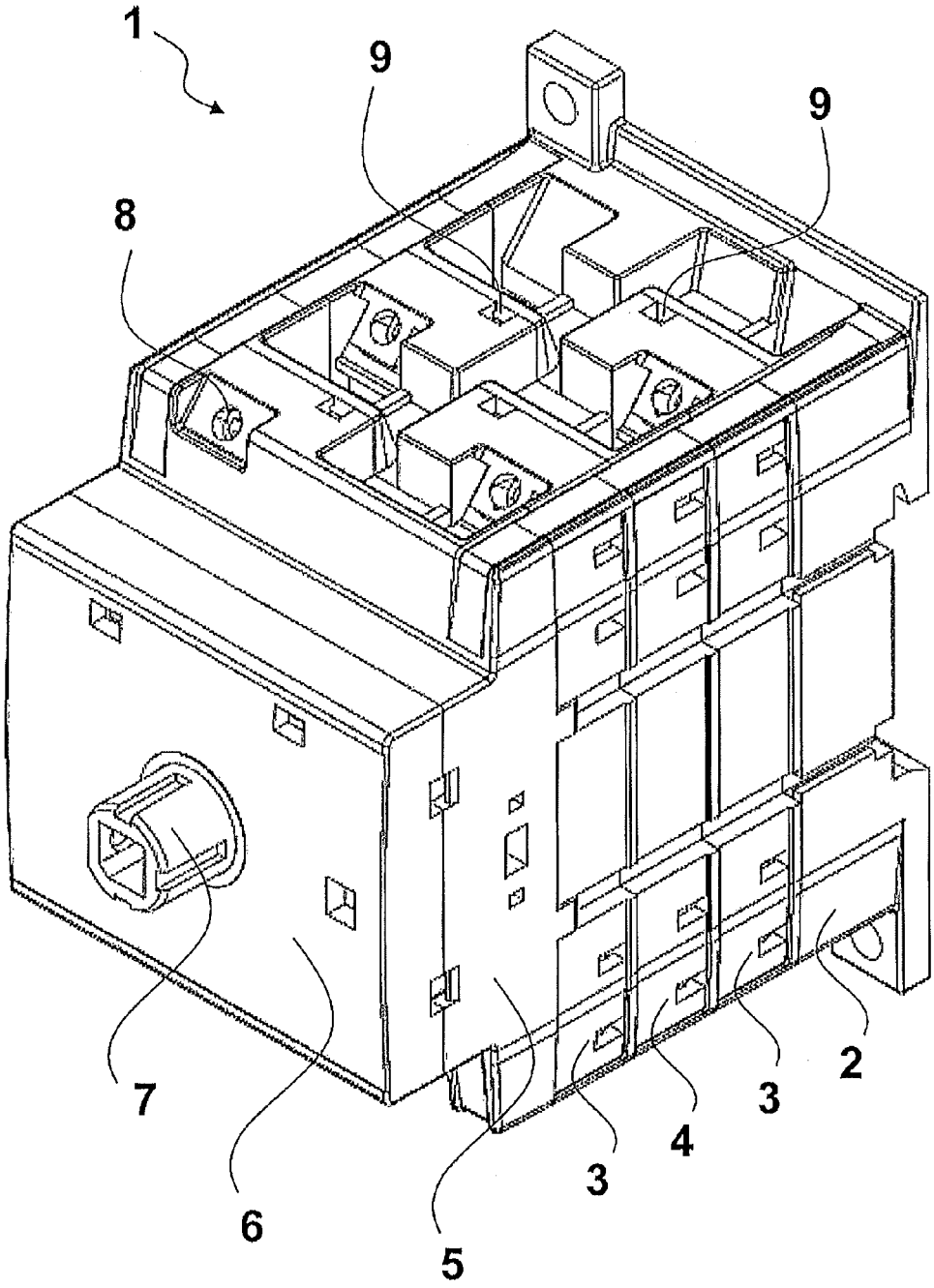
FIG. 1 shows a switch equipped to have four poles, according to an exemplary embodiment of the present disclosure.

Exemplary embodiments of the present disclosure provide a rotation mechanism for a rotary switch, and a method of operating a rotary switch.

Exemplary embodiments of the present disclosure provide a modular structure, where a substantially rectangular base body provided with a rail fastener and mounting bracket receives stationary contacts arranged to opposite corners like on the intermediate bodies stacked on it, wherein the overlapping contact modules are mirror images to each other concerning the location of stationary contacts.

In each contact module, the movable contact is, from the top, a rectangular blade provided with a contact spring, which is arranged to a slot of an element or roll forming the switch axis. The blade has a rectangular cross-section except a longitudinal rounded corner receiving the stationary contact.

The switch shaft is formed of contact module specific rolls. The roll has a slot open from the top for receiving a movable contact. In a switch that is fully equipped, the overlapping rolls set staggered, in a quarter revolution or 90 degrees angle to each other such that the shorter teeth of an upper roll set in the slot of a lower roll pressing and keeping in place a moving contact. The longer teeth of an upper roll fill slot holes of a lower roll, which would otherwise be left empty, to prevent an arc to fire and burn via those holes. The teeth arranged on the outer edge of the roll deliver the torque of the switch axis, whereby the effect of the clearance is substantially smaller because the contact surfaces of the movable contacts reside only on a slightly bigger radius. The movable contact is easy and quick to mount by lightly pressing it to the roll slot from the top. It is further possible to form wings close to the contact surfaces of the movable contact, on the outer edge of the roll, to alleviate in faster extinguishing of the arc. An opening is needed on the wing at the height of the stationary contact, but a small wing portion can be provided to direct the arc away from the outer edge of the roll which can become slightly conductive due to soot. On the backside of the movable contact there can be provided a bigger arc wall to prevent an arc to short with an opposite contact pair. When a pressure wave generated during the extinguishing process hits the arc wall, the wall operates as a member accelerating the opening of the contacts.

According to an exemplary embodiment, a mechanism module to be placed on top includes such members that achieve a quick contact operation independent of the user.

An intermediate body includes a round hole provided with shoulders to receive a roll, and in the base body the roll is received by a cup-like round space having arms limiting the rotation of the switch axis to 135 degrees, for example, when opened from a closed position to an open position. As the mechanism is positioned to an upper end of the switch shaft, and the arms limiting the motion to the lower end of the switch shaft, the complete closing and opening also of the lowest contacts is achieved independent of the clearances between the rolls delivering the force of the switch axis.

There are provided left-hand and right-hand versions of the intermediate and mechanism bodies, whereby the need of filling the gaps of stationary contacts and connection screws with loose elements is avoided. Furthermore, it has become possible to arrange the gas exhaust holes to the side from the center line of the body. Thereby ionized gas flows from adjacent modules being in different electric potential do not easily short and cause a dangerous arc.

The stationary contact is formed, seen from top, substantially to a form of the letter Y. The contact module body has a shape formed to receive the straight part and a first Y-branch, the other Y-branch operating as contact surface to a movable contact. When equipped to left- and right-hand bodies, the Y-branches of the contact work in opposite tasks. In this way, the contact becomes supporting the other Y-branch preventing the twisting movement of the contact which would allow the contact part to swing. Furthermore, the need of providing left and right-hand versions from the stationary contact is avoided.

FIG. 1 shows a switch 1 according to the an exemplary embodiment of the present disclosure, which is equipped to have four poles. In addition to the base body 2, the switch 1 includes three intermediate bodies (3, 4), which attach to each other with so called snap-in attachments, but instead of or in addition to the bodies made of insulating material can be glued, molded or attached by means of screws to each other. In the base body 2 shown in the figure as a right-hand body, it has a left-hand intermediate body 3 attached thereto, which has a right-hand intermediate body 3 attached thereto, the following body is a left-hand intermediate body 3, and finally a right-hand mechanism body.

The switch can be equipped for example, as a 9-pole switch, wherein there are an even number of intermediate bodies and a left-handed mechanism body 5.

The mechanism body 5 has a lid 6 having a round hole for the mechanism shaft 7. To the end of the mechanism shaft 7 can be attached a control handle, or an extension shaft in some switchgear assemblies when the handle is mounted to a door of the switchgear.

The base and intermediate bodies have holes for receiving and tightening a current conductor with a connector screw 8 from a hole of a next intermediate or mechanism body. On the lower surface of the intermediate or mechanism body there is arranged a gas exhaust hole 9 to the side of the center line such that the gas exhaust holes of overlapping modules lie further away from each other and connectors being in different electric potential to prevent firing of an arc.

Figure 2:
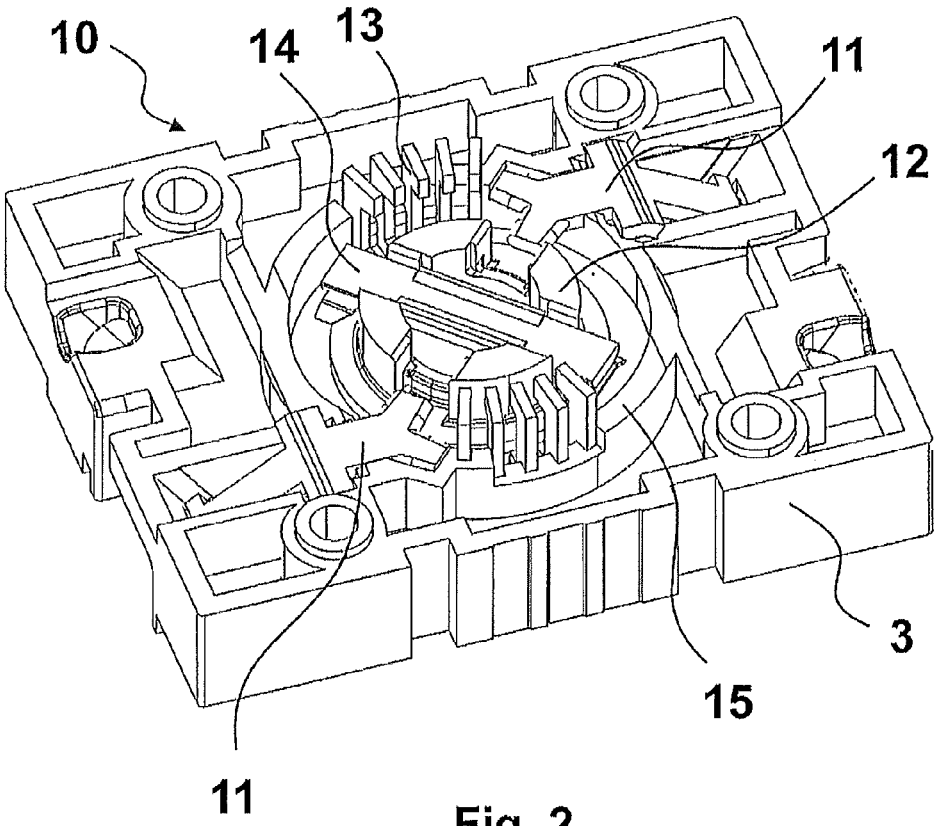
FIG. 2 shows a contact module having the contacts in an open position, according to an exemplary embodiment of the present disclosure.

FIG. 2 shows an equipped contact module 10. The left-hand intermediate body 3 mould from insulating material includes spaces for receiving two stationary contacts 11 and one rotating roll 12 and extinguishing plates 13 of magnetic metal alloy, such as iron, which can optionally be mounted. In the middle of the body there is provided a round hole, which receives a cylindrical lower part of the roll 12. An extinguishing chamber is formed by a surrounding wall 15. The wall 15 has a hole at the point of the extinguishing plates, from where a gas channel leads to the shorter side of the body, and further to a gas exhaust hole provided in a lower part of an upper contact or mechanism module provided in a fully equipped switch. The wall 15 has a hole for bringing the contact portion of the stationary contact into the extinguishing chamber. There is formed a space in the body for receiving the stationary contact, to which space the stationary contact form-locks, and the upper module prevents the stationary contact from escaping the space. The roll 12 and the movable contact 14, respectively, are in a position where the switch is open. In the module of the figure, there are four through holes for fastening screws.

When the contact module is built to the base body 2 or to a right-hand intermediate body 4, the stationary contacts 11 come as mirror images to the other side of the body. As the movable contact 14 is then perpendicularly or 90 degrees in angle to what has been presented in the figure, the spaces for receiving the extinguishing plates 13 are on the short side of the body, and therefore the gas exhaust channels are shorter.

Figure 3:
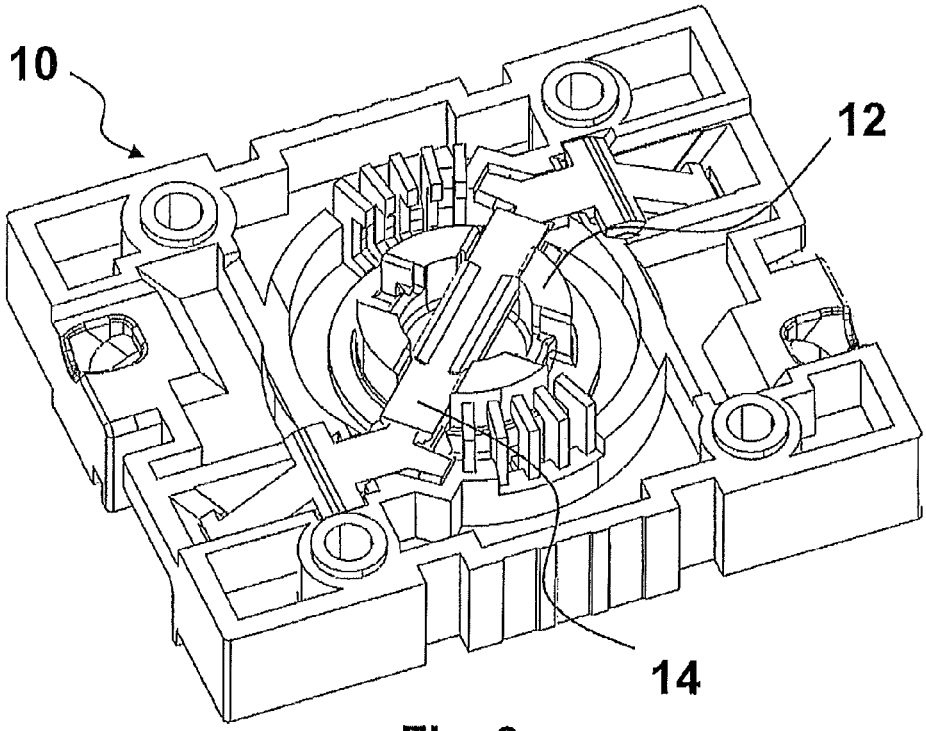
FIG. 3 shows a contact module having the contacts in a closed position, according to an exemplary embodiment of the present disclosure.

FIG. 3 shows a contact module 10 of preceding FIG. 2 such that the roll 12 and the movable contact 14 are turned into a position where the switch 1 is closed.

Figure 4:
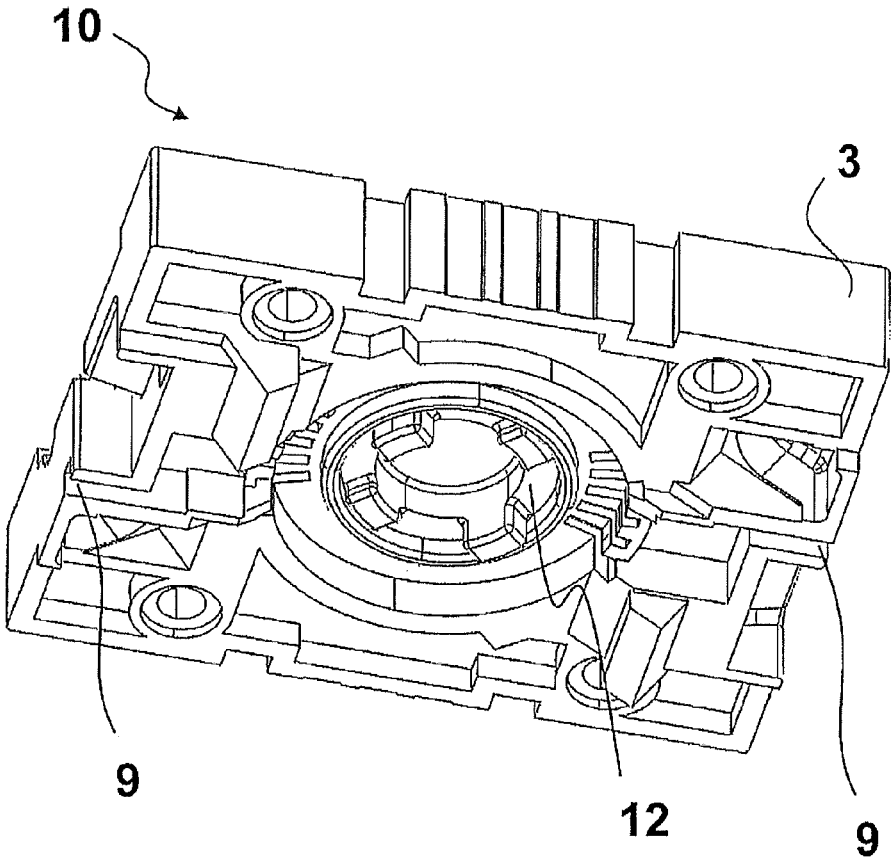
FIG. 4 shows a contact module seen from the underside, according to an exemplary embodiment of the present disclosure.

FIG. 4 shows a contact module 10 from the underside of a left-hand intermediate body 3. In the bottom of a left-hand intermediate body 3 there are provided spaces for the extinguishing plates and a gas exhaust channel for a right-hand intermediate body 4 or base body 2 that comes under the body 3. The gas exhaust holes 9 serving a lower contact module 10 are arranged to the side of the middle of a short side of the body, opposite to the own contact 11 of the intermediate module 3. There can be seen a bottom part of roll 12 that is placed into the round hole of the body.

Figure 5:
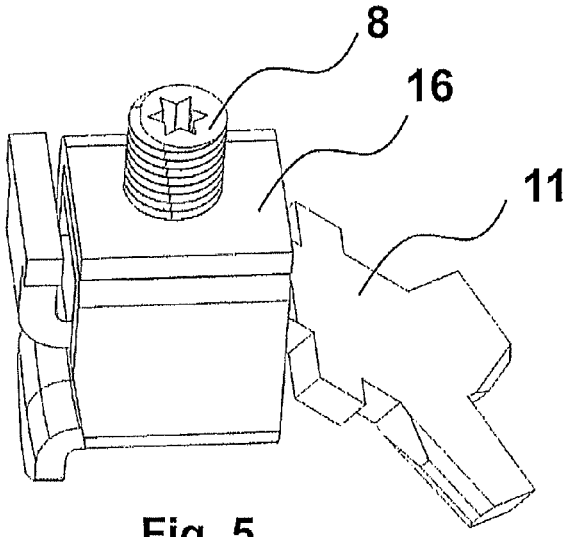
FIG. 5 shows a switch contact equipped with a connector lug, according to an exemplary embodiment of the present disclosure.

FIG. 5 shows a stationary contact 11 equipped with a contact lug 16 provided with a contact screw 8. The body of the stationary contact 11 may be manufactured of copper coated with silver, for example. The contact lug is technically one of the best alternatives for reliable connection of a multithread wire, especially. The contact screw is not in direct connection with the threads, and thus does not cut off the threads by grinding, but presses the conductor threads in the contact lug. The contact lug can be formed to U- or V-form, whereby the threads concentrate in the contact lug. Standardized stopper screws, such as torx- or hexagonal socket-head screws can be used as connection screws 8, which provide better tightening torque in view of the diameter of the tool head when compared to level- or cross-point tool. This enables that a small hole can be arranged to the body for the tool, whereby the connection screw does not fall out even if it would be completely screwed open.

Figure 6:
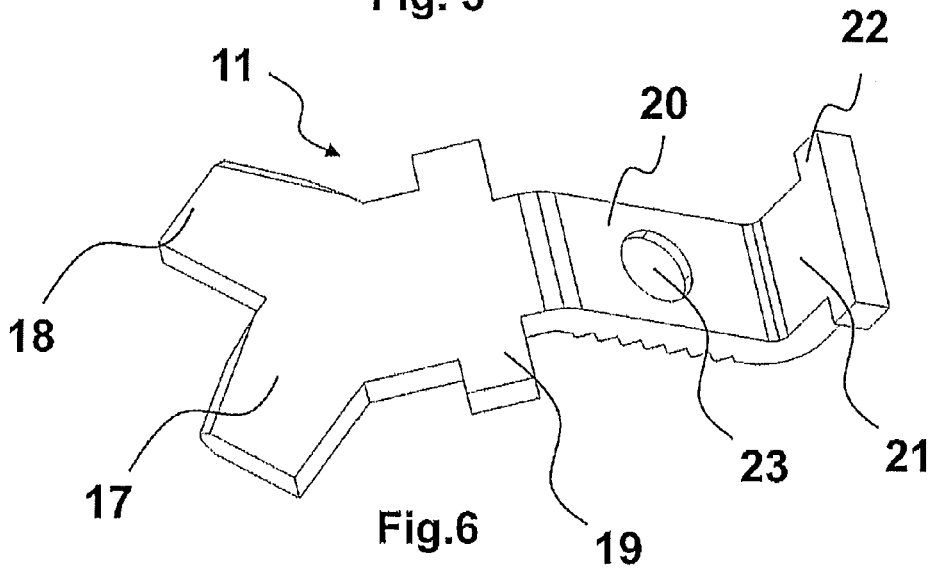
FIG. 6 shows a stationary contact seen from the top side, according to an exemplary embodiment of the present disclosure.

FIG. 6 shows the structure of a stationary contact 11 usable in connection with a contact lug 16. The contact includes two Y-branches, wherein when equipped to a right-hand body (2, 4), the space arranged to the body receives the first Y-branch 17 to support the contact and the second branch 18 acts as the contact's contact surface in the extinguishing chamber. In a left-hand body 3, the Y-branches act in inverse tasks, that is the Y-branch 17 acts as a contact surface and the branch 18 supports the contact to its place. The direct portion of the contact includes teeth 19, which serve in form-locking the stationary contact to the body of the switch. The connection portion 20 of the stationary contact, which may point, for example, towards the short side of the body, is bent downwards such that the connection screw 8 can be arranged to a favorable position for connecting the conductor. The rest of the connection portion 21 is bent upwards to prevent the contact lug 16 to displace from its place, and the rounded corner further helps pushing the conductor threads smoothly to the contact lug 16. The teeth 22 arranged at the end of the connection portion support find support in the body of the switch, but also assist in preventing the contact lug 16 to easily fall away from its place when being equipped. If the connection screw 8 has been turned a few revolutions towards the closed position, the contact lug can no longer fall away from its position. According to an exemplary embodiment, the top surface of the connection portion of the contact includes a hole 23 formed by pressing to centralize the connection screw 8 when the conductor is being tightened.

Figure 7:
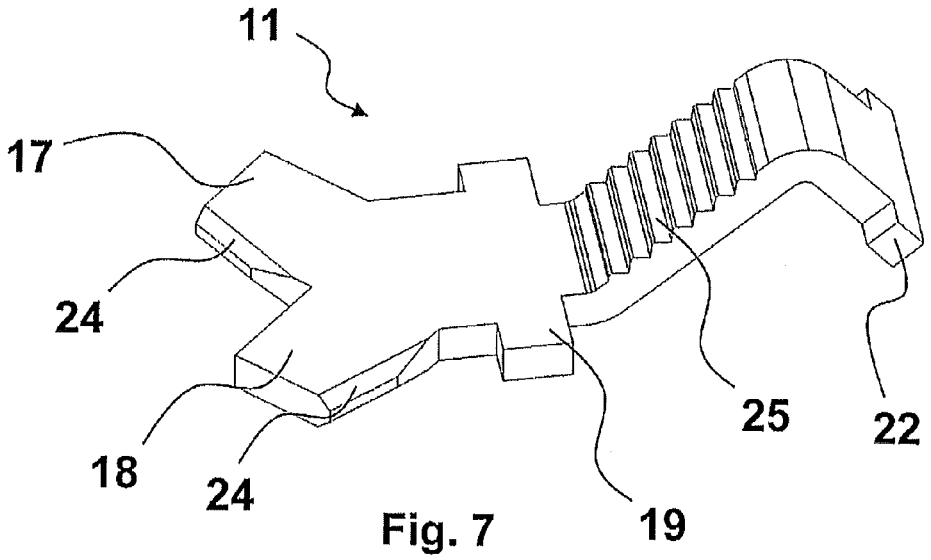
FIG. 7 shows a stationary contact seen from the underside, according to an exemplary embodiment of the present disclosure.

FIG. 7 shows a stationary contact 11 from the underside. The figure shows that the first side 24 of the Y-branches 17, 18 are slanted, which guides the contact surfaces in the contact event such that there will be no direct collision between these two. The second sides of the contact do not need to be slanted because the contact always takes place from the same direction in the left-hand and right-hand bodies. The connection portion is provided with a transversal knurl 25 to keep the connector reliably in its place even if under dragging. The inner side of the contact lug 16 that presses against the threads of the conductor can also be provided with a corresponding bush-hammering. Different embodiments of the stationary contact can be provided by changing the connection portion 20. For example, the connection portion 20 can be formed as straight and it can be dimensioned for an Abiko®-type push connector.

Figure 8A:
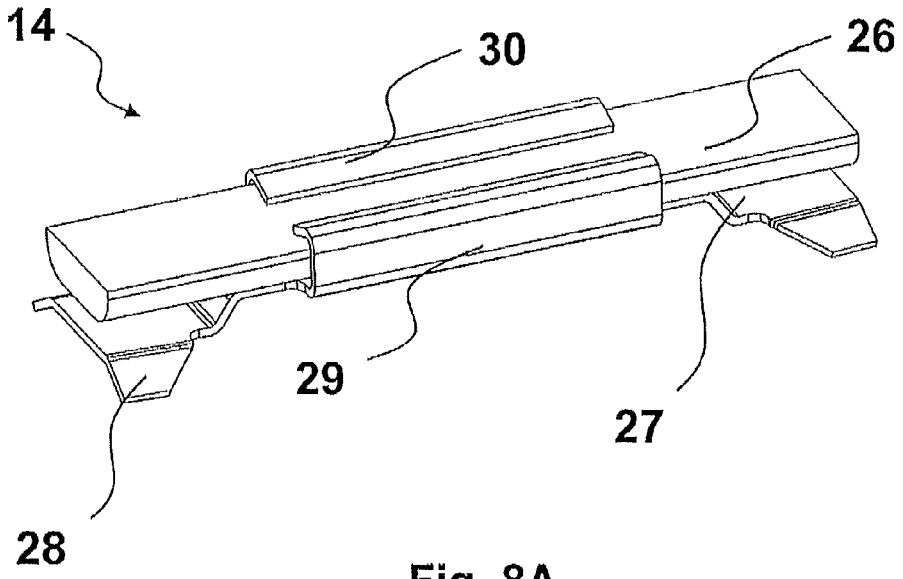
FIG. 8A shows a movable contact seen from the top side, according to an exemplary embodiment of the present disclosure.

FIG. 8A shows a movable contact 14, which includes a contact blade 26 and a contact spring 27. The contact blade 26 may be manufactured from copper coated with silver, for example. The contact blade is a straight blade, whose two longitudinal angles are rounded such that the cross-section profile becomes a narrow letter D having a substantially direct portion in the middle to provide a sufficiently large contact surface. The rounded angle meets the slanted or rounded edge 24 of the stationary contact 11 when the switch is being closed. In practice, both angles of the contact blade 26 can be rounded along the whole length of the blade even though functionally it would be sufficient to round only one angle of the blade from the portion which meets the stationary contact 11. The movable contact 14 includes a contact spring 27, which may be made of a stainless steel plate, for example. The purpose of the contact spring 27 is to guide the silver-plated contact surfaces of the stationary and movable copper contacts together, and press the contact during connection to reduce contact resistance, and to tempt the arc to itself to avoid wearing of the contact blade 26 due to the arc. The contact spring 27 may have the same length as the contact blade 26, and follows its lower surface except in both ends, where the contact spring is bent such a space is formed between the head of the contact spring and the contact blade to receive and cause a pressing force to the stationary contact. The contact spring 27 is wider from the both ends, and these portions that exceed the width of the contact blade are bent to a guiding surface 28 to prevent a collision when meeting the slanted edge of the stationary contact 11. Because the guiding surface is a sharp and outermost element of the movable contact, its outer edge easily receives the burning arc from the contact blade 26 when the contact is opened. From its center, the edges 29 of the contact spring 27 are bent to edges of the contact blade 26. According to an exemplary embodiment, the contact spring has folded portions 30 that extend to the other side of the contact blade for fastening the contact spring, or at least keeping it aligned with the contact blade 26. The ends of the edge meet the notches 35 of the slot 34 of the roll 12 such that the movement of the movable contact 14 is prevented in longitudinal direction.

Figure 8B:
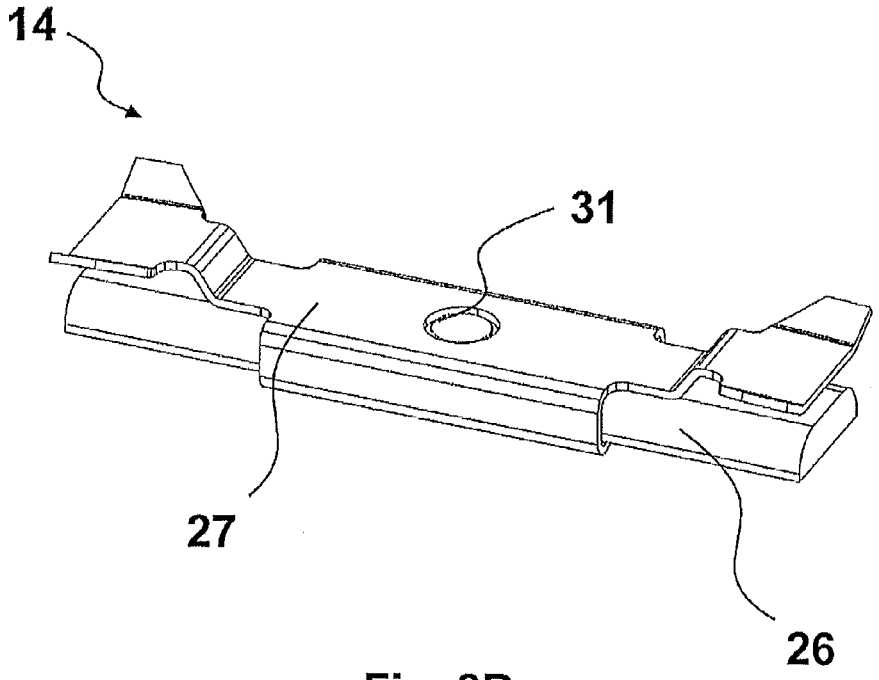
FIG. 8B shows a movable contact seen from the underside, according to an exemplary embodiment of the present disclosure.

FIG. 8B shows a movable contact 14 from the underside. The contact spring 27 has a hole 31 and the contact blade 26 has a respective rivet or swelling on the position of the hole to prevent the contact spring and the contact blade to slide with respect to each other in longitudinal direction. Other ways of locking can be provided to prevent sliding of the contact spring and the contact blade with respect to each other.

Figure 9A:
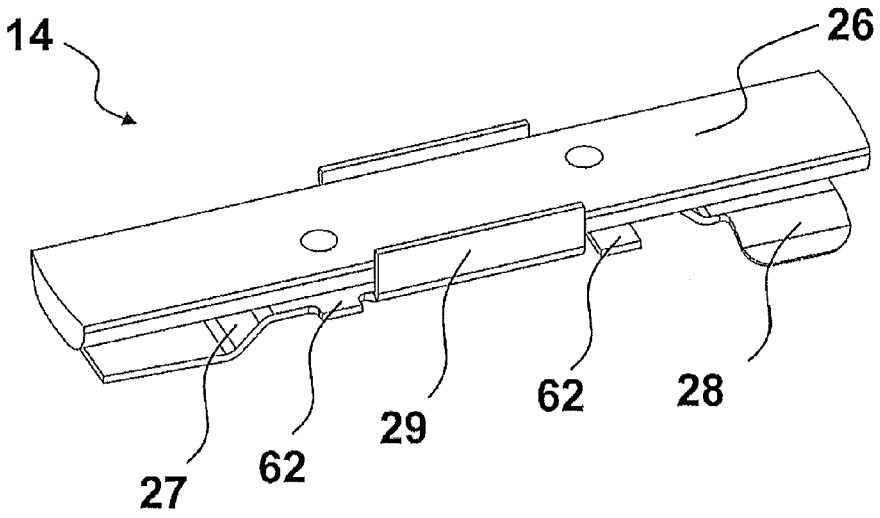
FIG. 9A shows an exemplary embodiment of a movable contact seen from the top side.

FIG. 9A shows another embodiment of the movable contact 14. The contact spring 27 is, at both ends, wider than the contact blade, and the portion of the contact spring that exceeds the width of the contact blade is bent downwards to serve as the guiding surface 28. The guiding surfaces 28 at opposite ends of the contact spring are arranged crosswise on opposite sides of the contact blade, that is, always on the side that receives the slanted edge of the stationary contact 11. From the middle, the edges 29 of the contact spring 27 are bent to the edges of the contact blade 26 to keep the contact spring aligned with the contact blade 26. To the contact spring 27, between the edge 29 and the bent end portion, there are formed locking teeth 62 that exceed the width of the contact blade 26, which locking teeth 62 meet the notches 35 formed to the edges of the slot 34 such that the movable contact cannot move in the longitudinal direction in the slot.

Figure 9B:
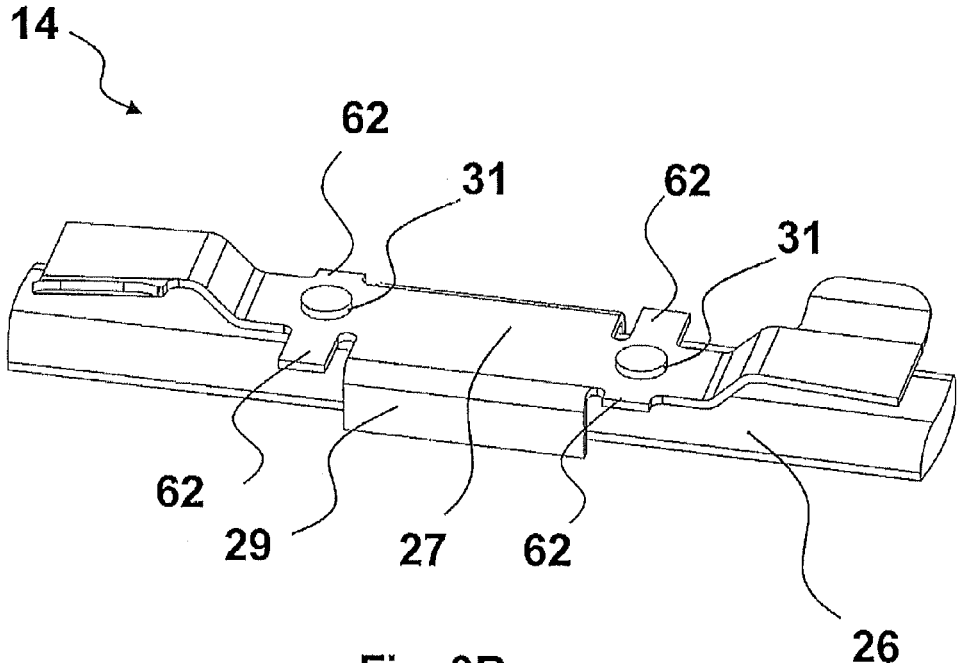
FIG. 9B shows an exemplary embodiment of a movable contact seen from the underside.

FIG. 9B shows another embodiment of the underside of the movable contact 14. Two holes 31 are arranged to the contact spring 27 for rivets. As the edges 29 have not been bent around the contact blade, riveting is needed to keep contact blade 26 and contact spring 27 attached to each other. The contact spring 27 is narrowed between the edge 29 and the guiding surface 28 on the side of the guiding surface to ensure the keeping of the arc in the guiding surface and preventing it to broaden to the middle of the contact spring. Due to this, the locking tooth 62 on the side of the guiding surface is longer, but the locking wings extend symmetrically equal length wider than the edge of the contact blade 26.

Figure 10:
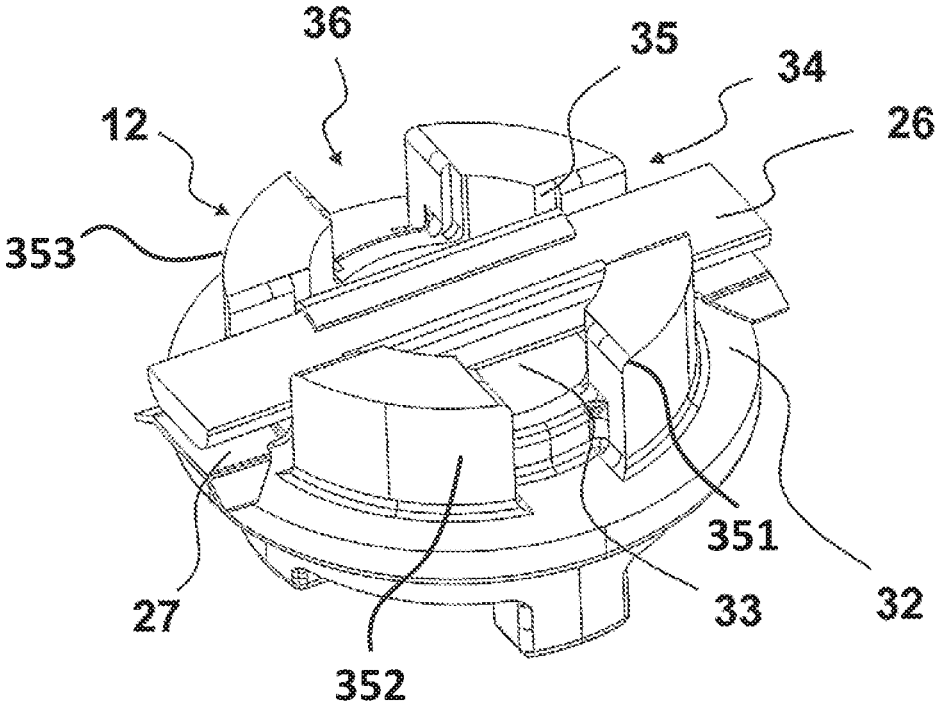
FIG. 10 shows a roll equipped with a movable contact, according to an exemplary embodiment of the present disclosure.

FIG. 10 shows a roll 12 made of insulating material. The roll has a form of substantially a thick-walled pipe axis, which has a smaller diameter, required by the rolling clearance, than the hole in the bottom or intermediate body. The roll includes on its outer surface a ring-like collar 32, which sets against the body of the contact module when the roll is mounted from the upside. The pipe-like portion of the roll has a plane-like intermediate wall 33 to isolate different modules electrically from each other. The top edge of the roll has a first slot 34 for receiving the movable contact 14. The first slot 34 has first to fourth teeth 35, 351, 352, 353 to receive the edge 29 of the contact spring or the locking teeth 62 to prevent longitudinal movement of the contact 14. The roll 12 has a second slot 36 for delivering the torque of the switch shaft.

Figure 11:
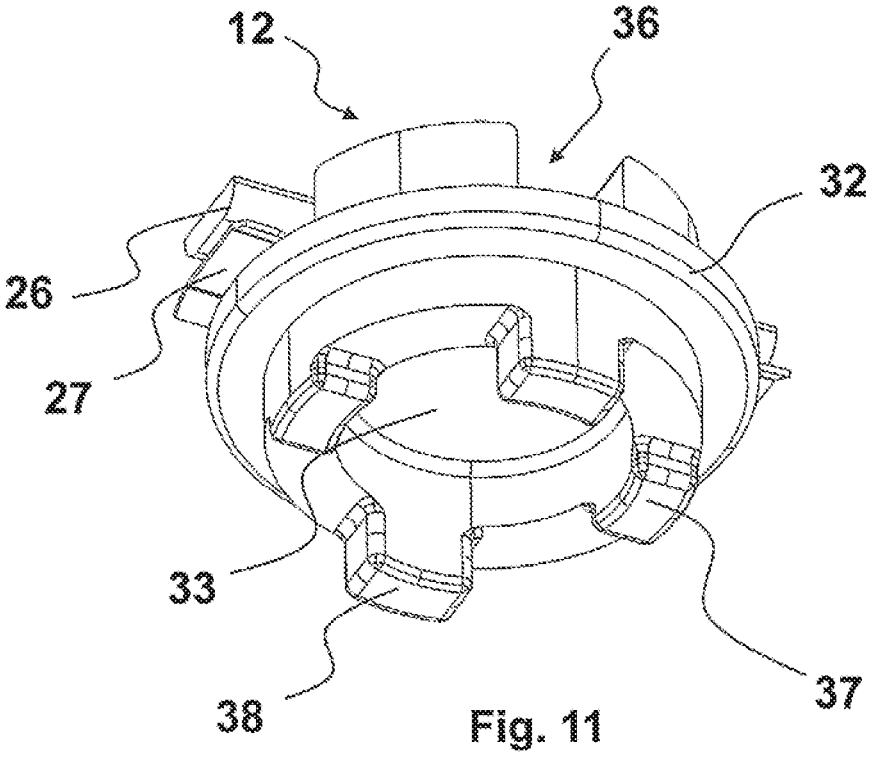
FIG. 11 shows a roll from the underside, according to an exemplary embodiment of the present disclosure.

FIG. 11 shows the roll 12 from the underside. To the lower part of the roll 12, there are arranged two wide slots, wherein the necks formed between them form four teeth. The width of the tooth corresponds to the width and form of the slot of the upper edge of the roll such that that a slot of an upper edge of a lower roll can receive a tooth of an upper roll. The opposite teeth 37, 38 have substantially equal length but the shorter tooth 37 is this shorter than the longer tooth 38 as required by the thickness of the movable contact and its vertical clearance. The long tooth 38 of the lower edge is aligned with a first slot 34 of the upper edge of the roll, and correspondingly the shorter tooth 37 is aligned with a second slot 36 of the upper edge of the roll.

Figure 12:
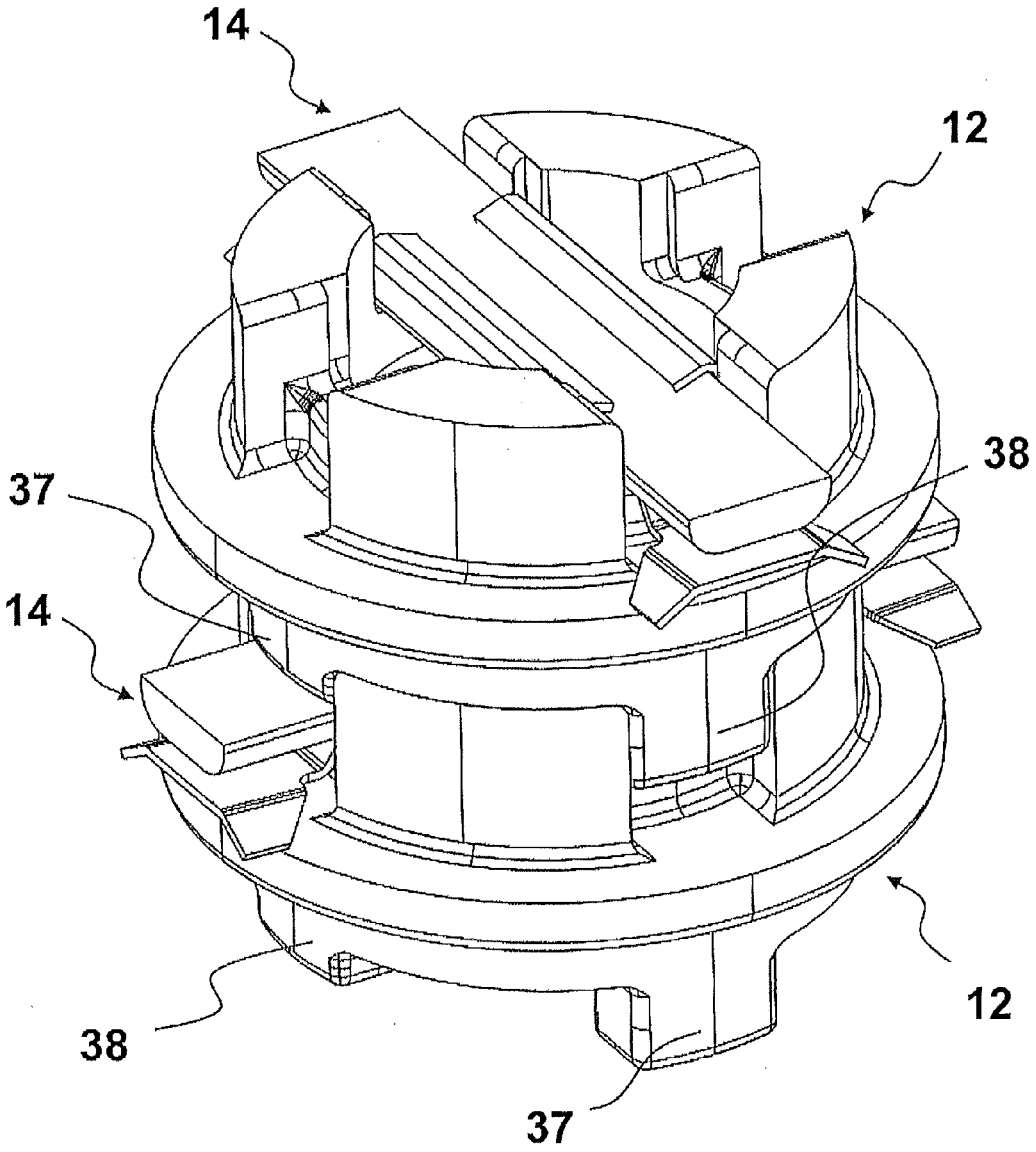
FIG. 12 shows two rolls connected to each other, each roll being provided with a movable contact, according to an exemplary embodiment of the present disclosure.

FIG. 12 shows interlacing of rolls 12 of two overlapping contact modules 10. The rolls are in 90 degrees angle to each other, whereby the movable contacts 14 are also perpendicular to each other. The contact 34 mounted to the first slot of the lower roll is supported by the shorter teeth 37 of the upper roll, and the longer teeth 38 fill the gap of the second slot 36 of the lower roll. The rolls form a switch shaft, whose torque is delivered on a wide radius due to the teeth, that is, at a radius from the rotation axis that is almost the length of the movable contact.

Figure 13:
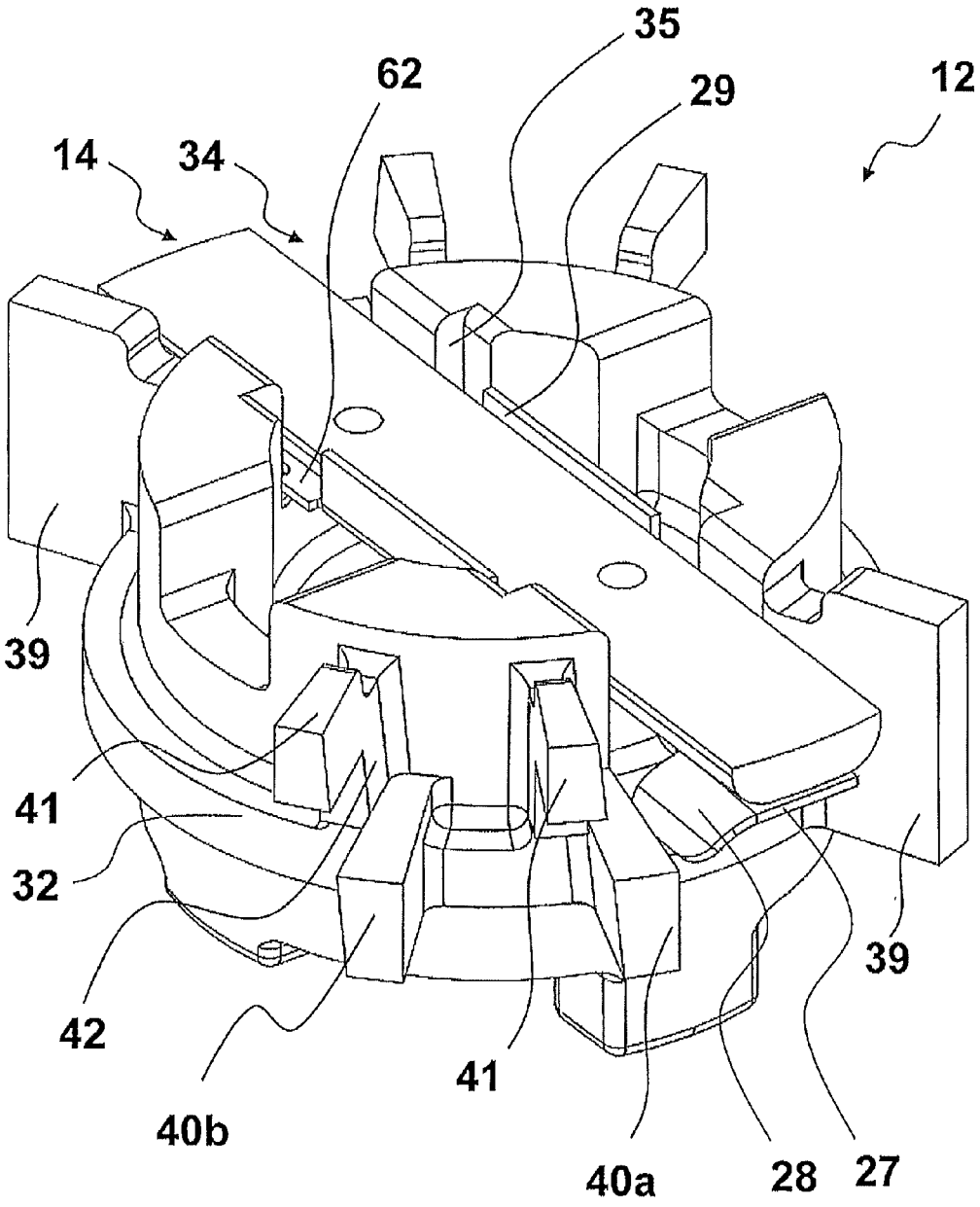
FIG. 13 shows a roll equipped with arc wings and blades, according to an exemplary embodiment of the present disclosure.

FIG. 13 shows another embodiment of the roll 12 and the contact spring 27 of the movable contact 14. There is arranged an arc wall 39 to the roll 12 adjacent to the movable contact 14, and behind the stationary contact 11 when equipped to the switch module. The arc wall 39 prevents the arc to broaden an arc of the opposite contact pair, in which case a short-circuit situation would occur. When the pressure shock of the arc building up hits the arc wall 39, it speeds up the opening of the contacts at the event of disconnection of the contacts. On the guiding surface side 28 of the contact spring of movable contact, that is, on the contact gap side of the contact pair of the contact spring 27, there are arranged arc wings (40, 41) such that the movable contact 11 fits between the lower and upper wings, or practically such that the roll 12 can freely rotate while the stationary contact remains in its place. The wings (40, 41) extend from the ring of the roll along the radius as far as the inner diameter of the extinguishing chamber wall 15 permits, taking into account the clearance. The lower arc wing 40*a* residing closest to the stationary contact is quite next to the slot 34 starting from the lower edge of the neck 32 and is so broad that the stationary contact fits to pass it. When the contacts are opened, an arc fires between the stationary contact 11 and the contact blade 26, but the other end of the arc moves contact blade 26 to the outer edge 28 of the contact spring 27, which resides outer and clearly lower than the contact surface of the contact blade 26. When the roll 12 rotates even more, a direct line of sight from the stationary contact 11 to the guiding surface 28 of the contact spring is broken, whereby the arc has to take a longer route and thus extinguishes more efficiently. When the roll is further rotated, other arc wings (40*b*, 41) remain therebetween. The top arc wing 41 is arranged overlappingly with respect to the respective lower wing 40, which may be due to manufacturing reasons, for example, but due to the asymmetry caused by the overlapping, the arc bends and the arc wings help to extinguish the arc by guiding it disadvantageously in view of burning. According to an exemplary embodiment, the arc wings can be formed such that a small neck 42 is formed at the place of the stationary contact 11, which neck lengthens the trip of the arc and guides the arc along the radius further away from the outer edge of the roll, which can have become sooty and thereby electrically conductive in use. At the both ends of the contact spring 27 only one guiding surface has been bent 28 on that side of the contact spring which receives the stationary contact, whereby the arc wall 39 can be positioned as close as possible to the contact blade 26. The edges 29 of the contact spring 27 have been bent perpendicularly upwards but the teeth 35 of the notches 35 of the first slot 34 have been arranged to receive the locking teeth 62 to keep the contact 14 longitudinally in its place.

Figure 14:
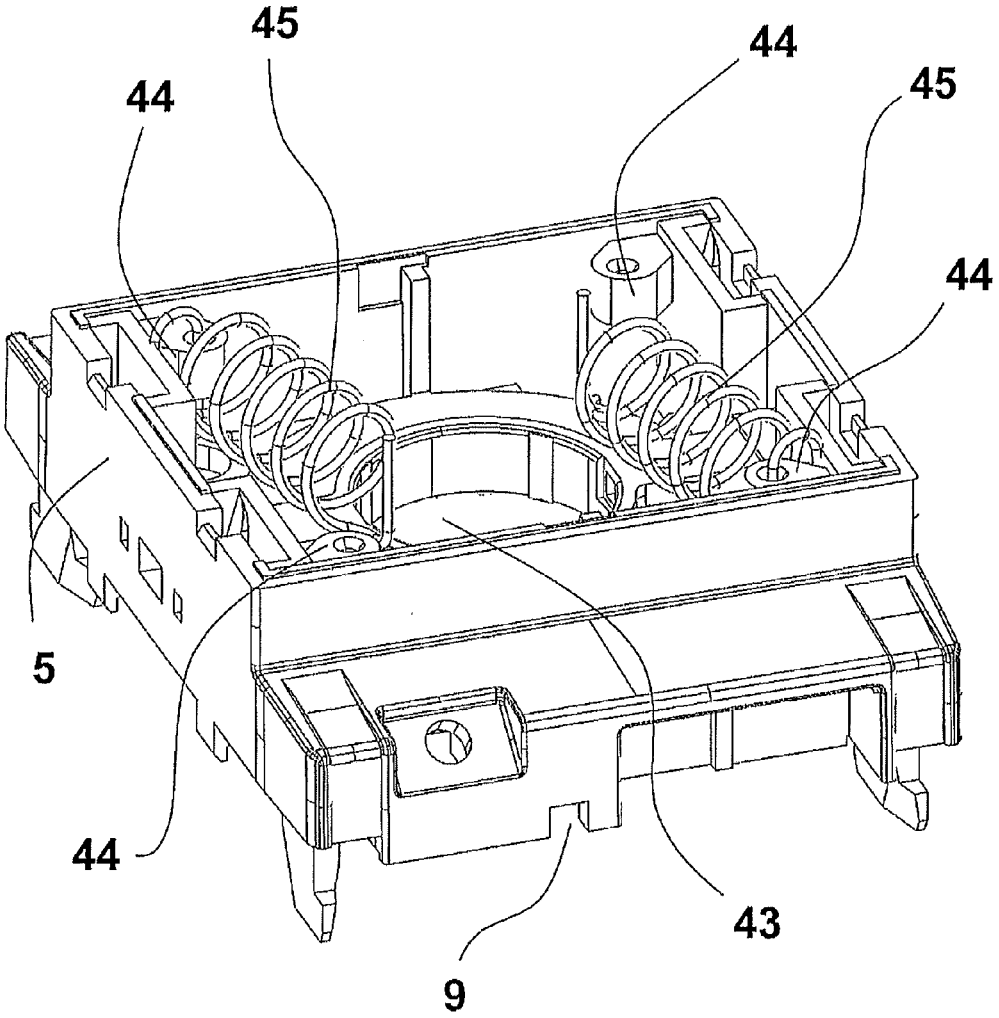
FIG. 14 shows a body of a mechanism provided with working springs, according to an exemplary embodiment of the present disclosure.

FIG. 14 shows a mechanism body 5. There are provided left- and right-hand versions of the mechanism body, as well as of the intermediate body. The mechanism body 5 is, from the underside, similar to the intermediate body, also having a round hole 43 perforating the body, and having a gas exhaust hole 9. The mechanism body has holes for a tool for the connection screw. The interior of the mechanism body receives the elements of the mechanism. To each corner there is arranged a mounting bracket 44 having a hole for receiving a first end of a working spring 45. The working spring is a coil spring, which is so stiff that it does not need a shaft to prevent buckling. The ends of the working spring are bent such that a direct portion of the spring wire residing at the end of the spring forms a diagonal line of a circle when seen from the end of the spring, and where the direct portions of both ends may be parallel to each other, for example. When the spring is mounted to its place, the ends of the spring can independently from each other point to either direction, but to ease the equipping of the mechanism module, the direct portion of the wire at the first end may point downwards, and the direct portion at the second end points upwards, for example. Then the working spring 45 can be placed to the hole in the bracket 44. Normally the switch is equipped with two working springs, but if the switch has very many poles, there can be provided three or four working springs. Depending on the spring force and the switch modules to be equipped, even one working spring can be sufficient.

Figure 15:
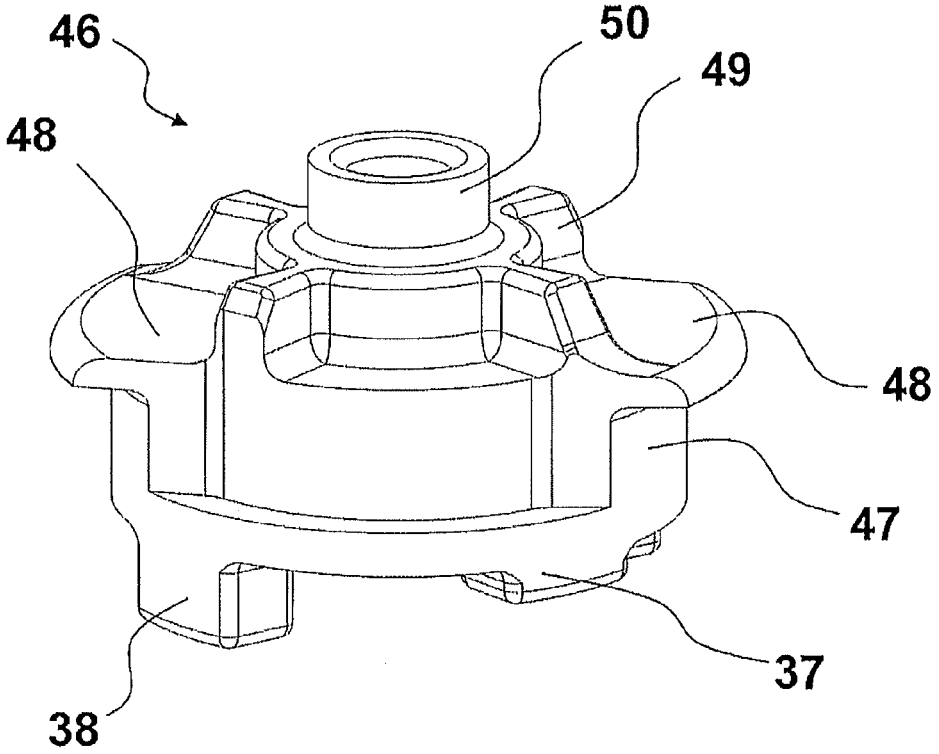
FIG. 15 shows a force transmission roll of the mechanism, according to an exemplary embodiment of the present disclosure.

FIG. 15 shows a force transmission roll 46 belonging to the mechanism, whose cylindrical portion 47 has diameter which is the clearance much smaller than the hole 43 of the mechanism body. The collar 48 meets the body when the force transmission roll is mounted to its place. The force transmission roll 46 has, similarly as the contact modules 12, short teeth 37 and long teeth 38 on the underside of the body for the force transmission. The force transmission roll has four narrow sector-formed arms 49 arranged on top of the collar 48, and a sleeve axis 50 topmost on the rotation axis.

Figure 16:
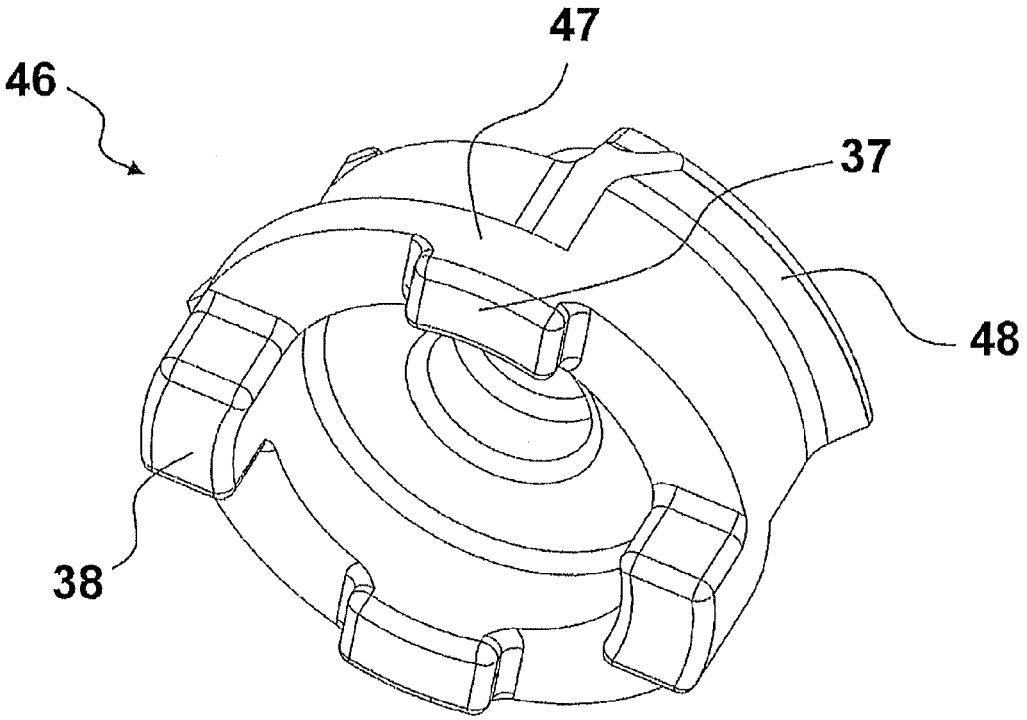
FIG. 16 shows a force transmission roll seen from the underside, according to an exemplary embodiment of the present disclosure.

FIG. 16 shows a mechanism roll 46 from the underside. The pipelike body has as extensions short teeth 37 and long teeth 38.

Figure 17:
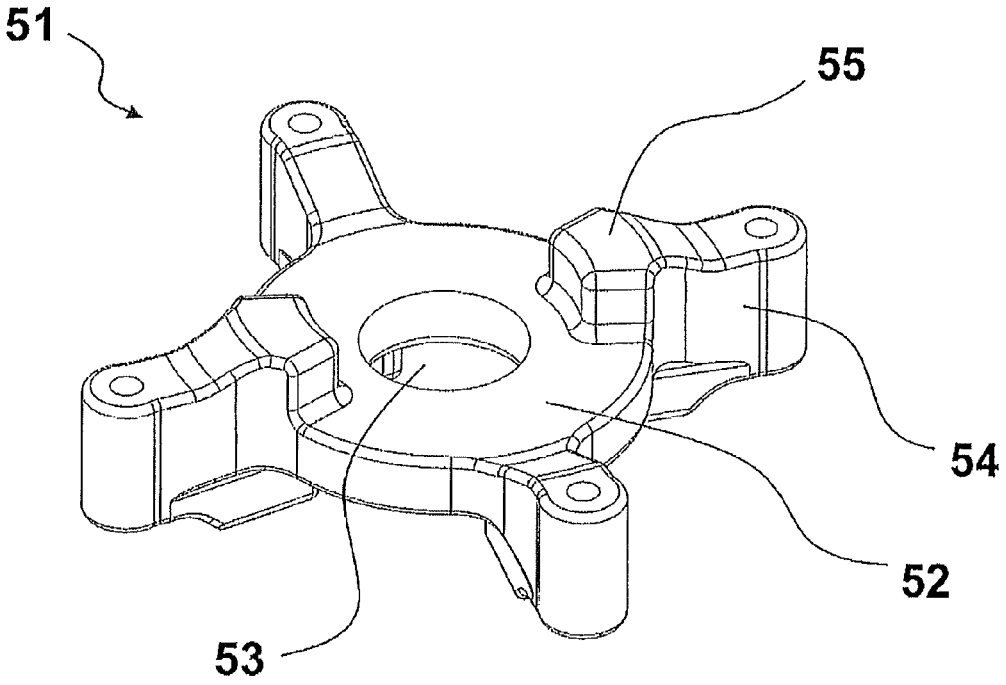
FIG. 17 shows a crank of the mechanism, according to an exemplary embodiment of the present disclosure.

FIG. 17 shows a crank 51. The crank includes a body 52, which has a round hole 53 for receiving a sleeve axis 50 of the force transmission roll 46 around which the crank is arranged to rotate. The body of the crank includes four mounting brackets 54, whose end has a hole for receiving one end of the working spring 45. The direct portion of the spring is mounted upwards, whereby the crank is pressed from the top such that the ends of the spring go to the holes of the mounting brackets 54.

Above the crank body 52 there are arranged two top branches 55 at the point of opposite mounting brackets.

Figure 18:
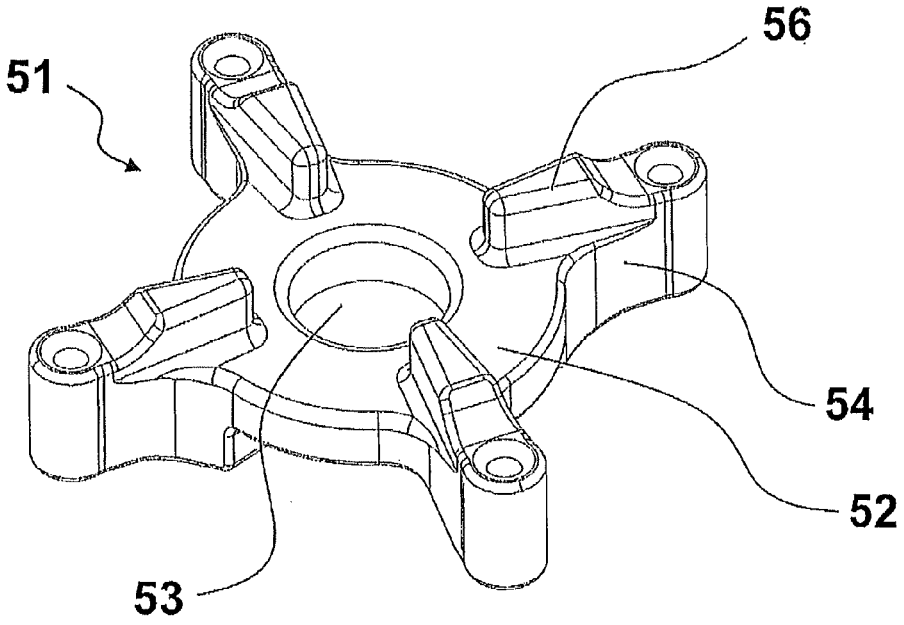
FIG. 18 shows the crank seen from the underside, according to an exemplary embodiment of the present disclosure.

FIG. 18 shows a crank 51 from the underside. The body 52 of the crank 51 has a hole 53, and the underside of the crank 51 body 52, at the point of each mounting bracket 54, has one sector-formed lower branch 56.

Figure 19:
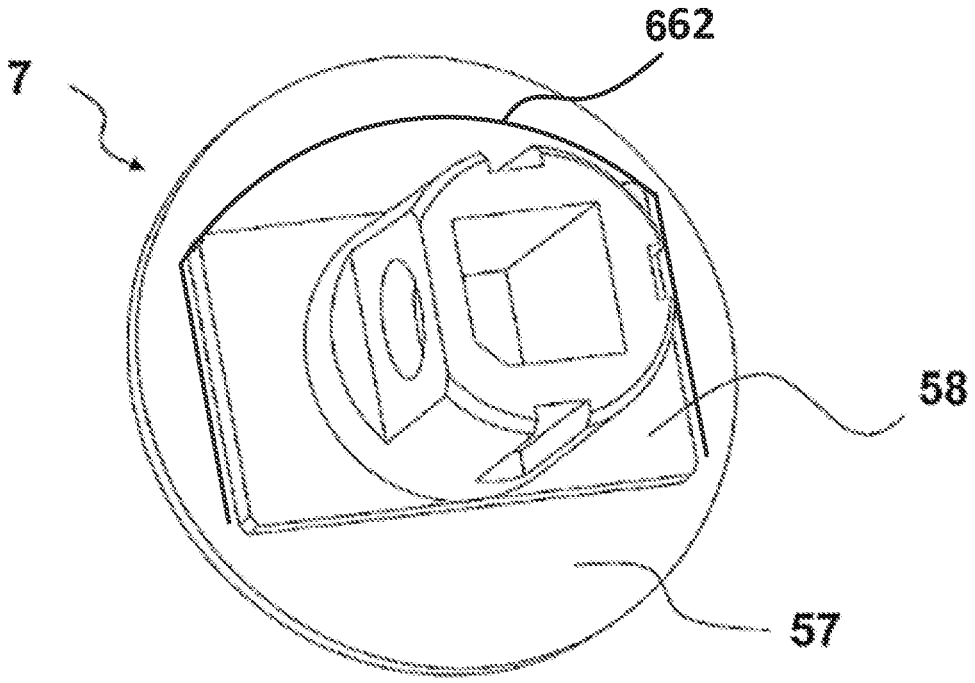
FIG. 19 shows an axis of a mechanism according to an exemplary embodiment of the present disclosure.

FIG. 19 shows a mechanism shaft 7, whose portion that projects out from the switch 1 cover 6 can have a control handle, and additionally an extension shaft, attached thereto. To the body 57 of the mechanism shaft 7 there is arranged a rectangular bossage 58 whose shorter sides residing further away from each other than the other sides are dimensioned to receive a so called rhythm spring. The rhythm spring 662 is a spring to be attached to the cover, such as a wire spring formed to a shape of letter U, for example, whose direct portions are at a distance of the short side of the bossing from each other. The rhythm spring is an option, which can be equipped to the inside of the cover 6 in a switch having a plurality of poles. The rhythm springs ensure that the mechanism shaft and the control handle set steadily to I-position without needless clearance if the working springs would not be able to push the contacts fully to the closed position. Normally, the working springs are able to push the contacts to the closed position, whereby the top branches 55 of the crank 51 push the mechanism axis 7 to the closed position, whereby there is no mentioned rotation clearance. To the inside of the cover 6, around the hole, there are arranged studs that meet the sides of the bossing 58 such that the mechanism axis can rotate 90 degrees between 0- and I-positions.

Figure 20:
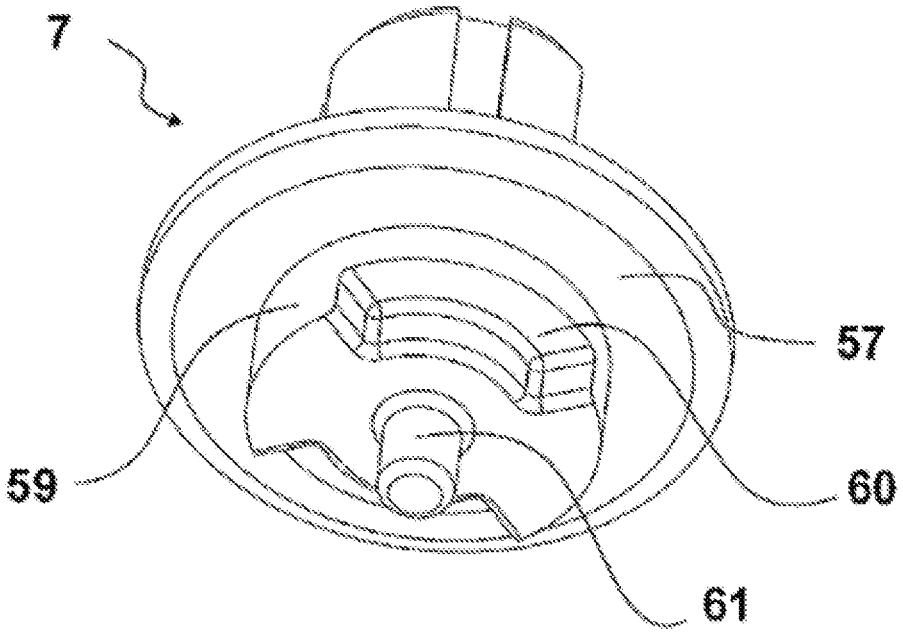
FIG. 20 shows an axis of a mechanism seen from the underside, according to an exemplary embodiment of the present disclosure.

FIG. 20 shows the mechanism axis 7 from the underside. On the underside of the body 57 there is a cylindrical extension 59, which has a smaller diameter than the diameter of the body. To the two opposite sides of the extension, there are arranged sector-like hollows 60 for receiving the upper branches 55 of the crank 51. There is also arranged a cone pin 61 to the end of the cylinder to be rotationally fit into the sleeve axis 50 of the force transmission roll.

The rapid operation of the contacts is based on utilization of the dead point of the pressure springs 45 and the crank 51.

In the normal state, the movable contacts 14, the rolls of the movable contact 12 and the force transmission roll 46 are at least 90 degrees, but at most 135 degrees, turned counterclockwise from the closed position to the open position. The working springs 45 push the crank 51 counterclockwise as much as the sector-like cavity 60 of the mechanism axis allows the top branch 55 to move. The dents 6 of the cover limit the movement of the mechanism shaft to a position where the shaft attached thereto points the 0-position of the switch.

When the mechanism axis 7 is turned from the 0-position clockwise towards I-position, the crank starts to rotate immediately when the sector-like cavities 60 begin to rotate the crank 51 with the help of upper branches 55. If the force transmission roll 46, and thereby the movable contacts 14, are turned 135 towards the open position, the force transmission roll starts, at the same time, to rotate with the crank 51. If the force transmission roll 46 and thereby the contacts 14 have been turned less than 135 degrees, the force transmission roll starts to rotate later. The force transmission roll 46, which has turned the minimum rotation 90 degrees, starts to rotate due to the crank only when the mechanism shaft 7 has been turned about 60 degrees.

When the mechanism axis 7 is a few degrees from the I-position, the crank 51 is in a turned position that much that the working springs are pressed to their shortest position, that is they are about to reach the dead point. After that, when the mechanism axis is turned a little more, the working springs 45 push the crank by a rapid movement to I-position. Then the lower branches of the crank and the movable contacts 14 of the rolls go to I-position. The lumps in the base body limit, by help of the long branches 38 of the lower roll, the movement of the switch axis such that the movable contacts stop into the closed position. The lower branches 56 of the crank 51 are pushed against the branches 49 of the force transmission roll 46, thereby limiting the movement of the crank thereto. The top branches 55 of the crank are being pushed against the edge of the sector-like cavities of the mechanism axis, whereby it prevents the mechanism axis 7 and its handle to turn away from the I-position, and on the other hand the edge of the rectangular bossing 58 of the mechanism axis hits the dent next to hole of the cover 6 to prevent the handle to rotate more than the I-position.

In sake of that the working springs 45 would not be able to turn the contacts to the closed position, and the crank 51 would not be able to turn the mechanism axis to I-position, there can be provided a so called rhythm spring to the underside of the cover 6, which keeps the handle in I-position, even if the crank would not support it into that position.

When the switch is being opened, and the mechanism shaft is started to be rotated from I-position counterclockwise towards 0-position, the crank 51 starts to move simultaneously the sector-like cavities 60 of the mechanism axis 7 pushing the top branches 55 of the crank 51. When the mechanism axis 7 has been turned counterclockwise about 60 degrees, the force transmission roll 46 joins the movement and the contacts start to open.

This ensures that possibly stuck contacts can be moved by the user, and when the contacts are fully welded, the control shaft can even not turn to 0-position. When turned a little more, the working springs reach their dead point and turn the crank 51 rapidly to the starting position corresponding to the 0-position of the switch. When the lower branches 56 of the crank 51 hit the branches 49 of the force transmission roll, it turns the force transmission roll and at the same turns the contacts about 90 degrees, but when the crank 51 stops, the switch axis continues its rotation at a high speed, however, such that that the studs of the base body limit the movement to about 135 degrees from the closed position.

In accordance with an exemplary embodiment, there is provided a switch including a contact module formed of a base body, which includes two stationary contacts and a roll, which receives a movable contact, and a mechanism body including elements for controlling the switch to open and closed positions. There is arranged a first slot on top edge of the roll, the slot being parallel the diameter of the roll and open from the top for receiving the movable contact, and a second slot perpendicular to the first slot, and to the bottom edge of the roll and a force transmission roll there are arranged teeth to be placed to the slots of a lower roll for conveying force in the switch shaft.

Between the base body and a mechanism body there can be arranged a contact module consisting of an intermediate body, which includes two stationary contacts and a roll for receiving a stationary contact. The shorter opposite teeth at the bottom edge of the roll or the force transmission roll are arranged to keep the movable contact of the lower roll in place, and the long teeth for closing the second slot the lower roll. The movable contact can include a contact blade and a contact spring, whose end is bent to receive a stationary contact and to press the contact surfaces of the contacts against each other. A broadening can be arranged at the end of the contact spring of the movable contact, which is bent as a guiding surface to guide the contact when the contact is being closed, and to operate as a second pole of an arc in a disconnection situation for protecting the contact blade. A broadening can be arranged at the middle part of the contact spring of the movable contact, whose edges are bent along the sides of the contact blade to be fitted to a space for locking the movable contact in longitudinal direction, which space is defined by notches arranged to the first slot of the roll.

To the middle part of the contact spring of the movable contact can be arranged locking teeth to be fitted to a space for locking the movable contact in longitudinal direction, which space is defined by notches arranged to the first slot of the roll. A stationary contact can be arranged to a contact module including a connection portion and two Y-branches, wherein the first branch is arranged to form-lock to the body to support the contact in its place, and the second branch is arranged to act as a contact surface of a stationary contact in a right-hand body and respectively the second branch is arranged to form-lock to the body to support the contact in its place and the first branch is arranged to act as a contact surface of the stationary contact in a left-hand body. To the stationary contact can be arranged a contact sleeve, whose contact screw is a hexagonal or torx-headed stopper screw.

The mechanism turning the switch axis includes a mechanism shaft arranged to mechanism body, a crank, working springs fastened, from the first end, to brackets of the body, and to crank brackets from the second end, and a force transmission roll, which mechanism axis is arranged to turn the crank, which is arranged to press the working springs to the dead point, after passing of which the working springs are arranged to push the crank, which is arranged to turn the force transmission roll, which is arranged to turn the movable contact to its open and closed positions with the help of the roll attached thereto. The crank can be provided with top teeth to be fitted to sector-like cavities arranged to a cylindrical extension of the mechanism axis to provide the free-play between the mechanism axis and the crank to prevent the user to affect the operating speed of the contacts. The crank can be provided with bottom teeth arranged to co-operate with the branches of the force transmission roll to provide the free-play between the crank and force transmission roll to allow turning of the crank from a closed position to open position to press the working springs an angle, when the contacts are in a closed position, where the working springs are below the dead point and the mechanism axis has rotated about 60 degrees, and the switch opening the free movement of the contact to open direction over a 90 degrees turning angle forced by the crank.

According to an exemplary embodiment, there is provided a switch including a body housing two stationary contacts and a roll for receiving a movable contact. The roll includes a first slot being parallel to the diameter of the roll and open from the top of the roll for receiving the movable contact to be contacted with the stationary contacts, a second slot arranged perpendicularly to the first slot, and teeth at the bottom of the roll to be placed to slots of a lower roll. As can be seen from FIG. 10, the first slot can be defined as the space that exists between the four pillar-like teeth that extend substantially from the middle of the roll towards the upside of the roll. According to an exemplary embodiment, the teeth are similar to each other having the same form and same length. The second slot can be seen as a longitudinal space that is perpendicular to the first slot, and defined by the same pillars as the first slot. The roll can include a first tooth, a second tooth, a third tooth and fourth tooth, and the first slot is defined by the space formed between the first and second teeth, the middle area of the roll, and the space between the third and fourth teeth, and the second slot is defined by the space between the first and third teeth and the space between the second and fourth teeth.

As can be seen, the slots are open from the top for receiving the movable contact and the teeth of a lower roll. Both of the slots pass along the diameter of the roll, that is, they pass via the rotation axis of the roll.

The roll includes, at the bottom of the roll, a pair of shorter teeth arranged opposite to each other for fitting to a first slot of a lower roll and keeping the movable contact of the lower roll in place, the roll further including a pair of longer teeth arranged opposite to each other for closing a second slot, that is the space between the teeth on the top side of the lower roll. The teeth of the roll and the slots are dimensioned such, that the teeth of the top roll fully or at least almost fully fill the slots of the lower roll.

The teeth at the bottom of each roll are aligned with slots at the top of the roll. In this way a plurality of similar rolls can be piled together as the teeth of an upper roll fit and substantially fill the slots of the lower roll when the movable contact is mounted to one of the slots on topside of each roll. As the movable contacts in successive rolls are arranged perpendicularly to each other, the successive rolls are arranged 90 degrees rotated to each other. Thereby, the first and third rolls, for example, are in mutually in the same rotational position.

The switch includes a base body arranged at the bottom of the switch and a mechanism body at the top of the switch including elements for controlling the switch to open and closed positions, the switch optionally including one or more intermediate bodies arranged between the base body and the mechanism body. That is, the base body can be the only body having the switchable contact elements, or there can be a plurality of, such as any of 1 to 9, for example, intermediate bodies between the base body and the mechanism body.

The mechanism body can include a force transmission roll which has teeth only on its underside. That is, the lower side of the force transmission roll is similar to the lower side of the rolls that are to be placed into base body and/or the intermediate body. The mechanism body can house a mechanism shaft, a crank and a force transmission roll form a switch shaft for rotating the one or more movable contacts with respect to the stationary contacts. Practically, the topmost part is a mechanism roll, which includes a shaft on top of the roll. These are all rotatable elements having a common rotation axis. The force transmission roll does not have any movable contact but is used in conveying the rotation force to lower rolls carrying the movable contacts.

The first slot is arranged to receive a substantially rectangular movable contact having a broadening in the middle of the contact fitting into the empty space of the roll and hitting the teeth or the roll thereby keeping the movable contact in place in longitudinal direction. That is, there can be a notch or an indentation in the teeth which is capable of receiving a broadening of the movable contact.

The base body includes a cup-like round space having arms that limit the rotation of a roll mounted to the base body by touching the longer teeth arranged on the bottom of the lowest roll. The base body thereby prevents that the pile of rolls cannot rotate more than desired. The arms or stoppage elements of the base body are arranged such that they point substantially towards the positions of the stationary contacts. Thereby, when the longer teeth of the lowest roll meet the stoppage elements, the rotary contact contacts the stationary contacts. The rotary contact is thus arranged to the roll such that it is in the slot that is aligned with the longer teeth. This applies to all rolls of the switch housing rotary contacts, and in all rolls the rotary contacts is aligned with the longer teeth of the roll, as in the successive roll the shorter teeth meet the rotary contact of a lower roll, and the rotary contacts of successive rolls are mutually perpendicular to each other.

The intermediate body includes a round hole, and the roll includes a collar, which collar prevents the roll falling through the hole when mounted to the body from topside. When the roll is mounted to the hole, the teeth on the top side of the roll remain above the hole. The shorter teeth on the lower side of the roll can be substantially at the level of the edges of the hole. The longer teeth of the lower side of the roll protrude below the level of the hole edges.

The mounting method proceeds as follows. First, the base body is taken and a roll is mounted to the cavity residing in the base body. A movable contact is mounted to the first slot of the roll and the stationary contacts are mounted to the body. Then, a second body, such as an intermediate body is mounted on top of the base body. A roll is placed to the second switch body such that a pair of short teeth on the bottom of the second roll set to the first slot of the first roll above the movable contact, and a pair of long teeth on the bottom of the second roll set to a second slot of the first roll. The intermediate body is not necessary but instead a mechanism body can be directly mounted to the base body. The mechanism body can include a force transmission roll, which takes the task of the second roll as described above.

In accordance with an exemplary embodiment, there is provided a movable contact for a rotary switch, including a first contact and a second contact, which first contact and second contact are arranged at distance from each other for receiving a stationary contact between the first contact and the second contact. The second contact is a spring element configured to bend allowing placing of the stationary contact between the first contact and the second contact. The second contact can have a fastening portion for fastening the second contact and the first contact to each other, the first contact and second contact being aligned with each other along the fastening portion, which fastening portion extends a distance from the middle of the movable contact towards both ends of the movable contact. The fastening portion can be arranged such that its length is substantially half of the total length of the movable contact. As it is arranged to the middle of the movable contact in longitudinal direction, it extends about a quarter of the length of the movable contact towards both ends of the movable contact. Along the fastening portion, the first and second contacts can touch each other. Along the fastening portion, the second contact can turn at least partly also to the opposite side of the first contact.

The second contact can have a projecting portion, which projects away from the plane of the fastening portion. The projection can be at an angle of about 45 degrees from the plane of the fastening portion. The second contact can narrower from the projecting portion than the first contact, which improves the spring effect by reducing the portion of the spring that carries out the bending function of the second contact.

The projecting portion can start from the fastening portion, or there can be provided an additional alignment portion between the fastening portion and the projecting portion. The alignment portion does not turn around the first contact but follows it only on the side of the first contact that makes the connection to the stationary contact.

The second contact includes a contact surface, which makes the contact to the stationary contact and presses the stationary contact against the first contact, which contact surface is aligned substantially parallel with the first contact. That is, the support is a substantially parallel surface to the first contact but due to the projecting portion it resides at a distance from the first contact. It can be provided that the support portion slightly approaches the first contact towards the end of the first contact. The angle between the two can be 5-15 degrees, for example. In this way the spring effect, that is, the pressing effect against the first contact, of the second contact is optimized.

The second contact can include a guiding surface for guiding the stationary contact between the support portion of the second contact and the first contact, which guiding surface projects away from the plane of the support surface. The angle between the guiding portion and the support portion can be 5 to 45 degrees, for example. The guiding surface can also be a curved surface such that the angle to the support surface is smallest close to the support portion but increases towards the end of the guiding surface. The guiding surface can be the outermost element of the movable contact to tempt a burning arc thereto. In accordance with an exemplary embodiment, the first contact is manufactured from copper coated with silver. The second contact can be made of stainless steel plate.

The first contact can have a rounded angle, which is configured to meet the stationary contact. Thereby the rounded angle and guiding surface together ensure that the stationary contact is received between the contacts even if received with high speed.

The second contact can have a widening at the fastening portion of the second contact, which widening extends wider than the width of the first contact, and the wider portion of the second contact is bent such that it extends along the sides of the first contact on both sides of the first contact, whereby the fastening portion of the second contact defines the outer surface of the movable contact at the middle of the movable contact for allowing the fastening of the movable contact to a rotary contact in longitudinal direction. In accordance with an exemplary embodiment, the second contact is such that its middle portions extend to the sides of the first contact only, that is they point perpendicularly to the level of the first contact when bent to the sides of the first contact.

The second contact includes a first receiving portion for receiving a stationary contact at a first end of the movable contact, and second receiving portion for receiving a stationary contact at a second end of the movable contact. The first receiving portion and the second receiving portion can be arranged on different sides of the movable contact and are mirror images of each other.

In accordance with an exemplary embodiment, there is provided a stationary contact for a rotary switch, including a connection portion for connecting to a conductor. The stationary contact includes a first portion and a second portion, which project from the connection portion such they form substantially a letter Y and which first portion and second portion can both serve as a contact portion for connecting the stationary contact to a rotary contact and as a support portion for supporting the stationary contact to the switch. The stationary contact can be substantially symmetrical, that is, the first and second portions extend from the connection portion in the same angle. The angle can be substantially 45 degrees.

The same Y-form stationary contact can be used on both sides of a rectangular switch. The same contact is also applicable in both left-hand and right-hand switch modules. The whole stationary contact may, for example, be made of the same material, which can be copper coated with silver, for example.

The outer edges of the first portion and the inner edge of the second portion can be slanted. The first portion refers here to the rightmost branch of the Y-shape stationary contact when mounted to the switch. The rightmost portion of the stationary contact is arranged to contact with the rotary contact when the stationary contact is mounted to the left edge of a side of the switch. The leftmost portion of the stationary contact contacts the rotary contact when mounted to the right edge of the switch module. In this case the inner, that is the edge that faces the rightmost portion of the stationary contact, is slanted to contact the rotary contact.

The stationary contact can include teeth extending perpendicularly from the end of the stationary contact, which assist in keeping the stationary contact in place in longitudinal direction. When the stationary contact is placed to contact lug and slightly tightened with the screw, the teeth prevent the stationary contact from slipping away from the contact lug.

In accordance with an exemplary embodiment, the top surface of the stationary contact includes a hole for receiving a screw. In another embodiment, part of the bottom surface of the connection includes a knurling for keeping the connector in place. As the conductor includes thin copper wire, which is placed against the knurling and tightened, the wires of the conductor become to follow the knurling. There becomes strong friction between the two preventing the conductor from slipping away from the connection with the conductor. In accordance with an exemplary embodiment, the contact lug holding the stationary contact also includes a knurling whereby the conductor is being placed between two knurled surfaces.

In accordance with an exemplary embodiment, the connection portion includes a downward bent portion for assisting in receiving a screw that is used in connecting a conductor to the stationary contact.

In accordance with an exemplary embodiment, the connection portion includes an upwards bent portion at the end of the stationary contact bent to prevent a contact lug to be displaced from its place.

In accordance with an exemplary embodiment, the stationary contact includes teeth that extend perpendicularly from the connection portion for locking the stationary contact to the body.

The switch can include a first body of a first type and a second body of a second type. The first and second types can be mirror images of each other. The two bodies are mounted together, wherein both of the bodies house similar stationary contacts. In the first body the first portion acts as a contact surface and the second portion acts as a support surface, and in the second body the first portion as a support surface and the second portion acts as a contact surface.

When mounting the above switch, the procedure includes steps of providing a first body of a first type, mounting a first stationary contact to the first body, providing a second body of a second type to be mounted overlapping to the first body, mounting a second stationary contact to the second body, wherein the first stationary contact and the second stationary contacts face the same side of the switch but are misaligned with each other, and wherein the first stationary contact and second stationary contacts are similar.

In accordance with an exemplary embodiment, there is provided a rotation mechanism for a rotary switch, the mechanism including a mechanism shaft for switching the switch between open and closed positions of the switch, a crank rotationally connected to the mechanism shaft, a spring connected to the crank, wherein the spring has a dead point between the open and closed positions of the switch, a force transmission roll rotationally connected to the crank, wherein the mechanism shaft, crank and force transmission roll have a common axis of rotation, and wherein there is a predetermined rotational free-play between the rotation of the mechanism shaft and the crank, and a predetermined rotational free-play between the rotation of the crank and the force transmission roll.

As can be seen from FIGS. 19 and 20, the mechanism shaft can have the form a roll, where a shaft for the handle projects from the surface of the roll.

According to an exemplary embodiment, the open and closed positions may be arranged such that the mechanism shaft rotates substantially 90 degrees when switching between the two positions. The spring, which is attached to the crank and to the mechanism module, is arranged such that it has a dead point during the rotation of the shaft. The dead point refers to the situation where the spring is at its shortest position. The dead point is arranged such that it is reached when the switch has been rotated about 75 to 85 degrees, for example, about 80 degrees from the full 90 degree rotation. In this way it is avoided that the fast rotation of the switch shaft after the dead point of the spring is as short as possible, whereby hurting the user of the switch is avoided when operating the switch.

The switching mechanism includes three different parts, mechanism shaft, crank and a force transmission roll, which are rotatable around the same rotation axis. The mechanism shaft is the topmost, and the force transmission roll the lowest part, and the crank resides between the two. There is a predetermined rotational free-play between the crank and the two other parts. The rotation of the mechanism is arranged such that the rotation of the crank follows the rotation of the mechanism shaft until the dead point of the spring. After the dead point, the rotational engagement of the two ends, and the crank is rotated, by the help of the spring, more than the mechanism shaft. As explained above, the mechanism shaft rotates only about 15 degrees or less after the dead point of the spring, but the crank rotates the amount of free-play between the two more than the mechanism shaft. The amount of free-play can be about 60 degrees. Thus, if the mechanism shaft would rotate about 10 degrees, the crank would rotate about 70 degrees.

The free-play between the mechanism shaft and the crank is arranged by providing a wall sector on the mechanism shaft, which is arranged to rotate between two arms of crank, wherein the difference between the angular length of the wall sector and the angular difference between the arms of the crank defines the rotational free-play between the mechanism shaft and the crank. According to an exemplary embodiment, the crank can have two arms on the side against the mechanism shaft and four arms against the force transmission roll. Thus, the arms against the mechanism shaft are arranged substantially at 180 degree's intervals. The sector in the mechanism shaft is about 120 degrees, whereby the free-play between the two is about 60 degrees. The force transmission roll has four teeth similarly as the lower side of the crank. The widths of the mutual elements are such that the free-play between the two is also about 60 degrees.

The engagement of the rotation of the crank and the force transmission roll is arranged such that the force transmission roll engages to the rotation of the crank before the dead point of the spring. The exact moment depends on how far the force transmission roll had continued to rotate at the previous switching event.

The switch includes a mechanism body housing at least part of the mechanism shaft and the crank, which mechanism body includes a mounting bracket for receiving one end of the spring. The crank includes two or four arms for mounting a spring to the end of each arm. The ends of the spring are bent perpendicularly to the longitudinal direction of the spring, and the ends of the spring point to opposite directions, and one end of the spring is connected to the crank and one end to the mechanism body. The crank and the mechanism body can have holes for receiving the round cross-section of the spring. Depending on the needed switching power, 1 to 4 springs can be mounted to the mechanism module.

The mechanism body includes a cover, and the mechanism axis includes a rectangular projection on the top side of the mechanism axis facing the cover, and the cover includes projections supporting a substantially rectangular rhythm spring, the rhythm spring forcing and limiting the rotation of the mechanism axis to 90 degrees.

The switch includes one or more bodies housing one or more stationary contacts of the switch, each body housing a roll for rotating the movable contacts of the switch, the force transmission roll including one more teeth to be mounted to respective recesses of the roll of the topmost body such that the force transmission roll and the roll of the topmost body are rotationally engaged to each other.

The lowest body includes stoppage walls for meeting the teeth of the lowest roll for stopping the rotation of the roll mounted to the lowest body and possible other rolls mounted between the lowest roll and the force transmission roll.

When the switching event is seen as a method, the method includes steps of initiating the rotation of a mechanism shaft from a first position to a second position of the switch, which rotation engages a crank connected to a spring and rotationally coupled to mechanism shaft, rotating the mechanism shaft further such that the spring approaches its dead point, wherein close to the dead point of the spring the crank engages a force transmission roll rotationally coupled to the crank, and rotating the mechanism shaft further such that the spring passes the dead point, wherein after the dead point the crank and the force transmission roll rotate more than the mechanism shaft.

It is clear that the details can vary within the scope of the claims. The disclosure is not limited to direct current switches but the disclosure can be used in many applications where corresponding switches are used.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A rotation mechanism for a rotary switch, wherein the mechanism includes:

a mechanism shaft configured to switch the switch between open and closed positions of the switch;

a crank rotationally connected to the mechanism shaft;

a spring connected to the crank, the spring having a dead point between the open and closed positions of the switch; and a force transmission roll rotationally connected to the crank, the mechanism shaft, the crank and the force transmission roll having a common axis of rotation, and wherein there is a predetermined rotational free-play between a rotation of the mechanism shaft and the crank, and a predetermined rotational free-play between a rotation of the crank and the force transmission roll, and wherein the switch includes one or more bodies housing one or more stationary contacts of the switch, each body housing a roll for rotating the movable contacts of the switch, the force transmission roll including one or more teeth to be mounted to respective slots of the roll of the topmost body such that the force transmission roll and the roll of the topmost body are rotationally engaged to each other.

2. A rotation mechanism according to claim 1, wherein the mechanism shaft and the crank are, during the rotation of the mechanism shaft, rotationally engaged to each other until the dead point of the spring.

3. A rotation mechanism for a rotary switch according to claim 2, wherein the dead point of the spring is arranged to a position, when the mechanism shaft has been rotated about 75 to 85 degrees of its 90 degrees rotation angle.

4. A rotation mechanism according to claim 1, wherein the spring is configured to rotate the crank with respect to the mechanism shaft by an amount of the rotational free-play after the spring has reached its dead point.

5. A rotation mechanism according to claim 4, wherein the rotational free-play between the mechanism shaft and the crank is about 60 degrees.

6. A rotation mechanism according to claim 4, wherein there is a rotational free-play between the crank and the force transmission roll at the beginning of rotation of the mechanism shaft from at least one of the closed and open positions towards the other position, wherein the crank is configured to engage the force transmission roll to the rotation of the crank before the spring reaches its dead point.

7. A rotation mechanism for a rotary switch according to claim 4, wherein the dead point of the spring is arranged to a position, when the mechanism shaft has been rotated about 75 to 85 degrees of its 90 degrees rotation angle.

8. A rotation mechanism according to claim 1, wherein the rotational free-play between the mechanism shaft and the crank is about 60 degrees.

9. A rotation mechanism according to claim 1, wherein the mechanism shaft includes a hollow at the bottom of the mechanism shaft, the hollow being configured to receive an arm of the crank and allow movement of the crank arm in the hollow, the movement of the crank arm defining the rotational free-play between the mechanism shaft and the crank.

10. A rotation mechanism for a rotary switch according to claim 9, wherein the crank includes two upper arms on the top side of the crank for engaging to the mechanism shaft, the upper arms being arranged opposite to each other.

11. A rotation mechanism according to claim 1, wherein there is a rotational free-play between the crank and the force transmission roll at the beginning of rotation of the mechanism shaft from at least one of the closed and open positions towards the other position, wherein the crank is configured to engage the force transmission roll to the rotation of the crank before the spring reaches its dead point.

12. A rotation mechanism for a rotary switch according to claim 1, wherein the switch includes a mechanism body housing at least part of the mechanism shaft and the crank, the mechanism body including a mounting bracket for receiving one end of the spring.

13. A rotation mechanism for a rotary switch according to claim 1, wherein the crank includes two upper arms on the top side of the crank for engaging to the mechanism shaft, the upper arms being arranged opposite to each other.

14. A rotation mechanism for a rotary switch according to claim 1, wherein the crank includes at least one arm, wherein the at least one arm includes a hole at the end of the arm for receiving an end of the spring.

15. A rotation mechanism for a rotary switch according to claim 1, wherein ends of the spring are bent perpendicular to a longitudinal direction of the spring, the ends of the spring point to opposite directions, and one end of the spring is connected to the crank and one end to the mechanism body.

16. A rotation mechanism for a rotary switch according to claim 1, wherein the mechanism body includes a cover, the mechanism shaft includes a rectangular projection on a top side of the mechanism shaft facing the cover, and the cover supports a substantially U-shaped spring, the spring forcing and limiting the rotation of the mechanism shaft to 90 degrees.

17. A rotation mechanism for a rotary switch according to claim 1, wherein the dead point of the spring is arranged to a position, when the mechanism shaft has been rotated about 75 to 85 degrees of its 90 degrees rotation angle.

18. A rotation mechanism for a rotary switch according to claim 1, wherein a lowest one of the bodies includes stoppage walls for meeting the teeth of the lowest roll for stopping the rotation of the roll mounted to the lowest body and other rolls mounted rotationally engaged to the roll of the lowest body.

19. A method of operating a rotary switch, the method comprising:

initiating rotation of a mechanism shaft from a first position to a second position of the switch, the rotation engaging a crank connected to a spring and rotationally coupled to the mechanism shaft;

rotating the mechanism shaft further such that the spring approaches its dead point, wherein close to the dead point of the spring, the crank engages a force transmission roll rotationally coupled to the crank;

rotating the mechanism shaft further such that the spring passes the dead point, wherein after the dead point the crank and the force transmission roll rotate more than the mechanism shaft; and forming the rotary switch to include one or more bodies housing one or more stationary contacts of the switch, each body housing a roll for rotating the movable contacts of the switch, the force transmission roll including one or more teeth to be mounted to respective slots of the roll of the topmost body such that the force transmission roll and the roll of the topmost body are rotationally engaged to each other.

* * * * *